US008698791B2

(12) United States Patent
Mori et al.

(10) Patent No.: US 8,698,791 B2
(45) Date of Patent: Apr. 15, 2014

(54) DISPLAY APPARATUS AND DRIVING METHOD FOR THE SAME

(75) Inventors: Hideo Mori, Mobara (JP); Takuya Higaki, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 308 days.

(21) Appl. No.: 13/149,607

(22) Filed: May 31, 2011

(65) Prior Publication Data

US 2011/0298775 A1 Dec. 8, 2011

(30) Foreign Application Priority Data

Jun. 8, 2010 (JP) ..... 2010-131248
Apr. 13, 2011 (JP) ..... 2011-089375

(51) Int. Cl.
*G09G 5/00* (2006.01)

(52) U.S. Cl.
USPC ..... 345/211; 345/690

(58) Field of Classification Search
USPC ..... 345/211, 690
See application file for complete search history.

(56) References Cited

U.S. PATENT DOCUMENTS

| | | | | |
|---|---|---|---|---|
| 5,748,160 | A | 5/1998 | Shieh | |
| 7,403,177 | B2 | 7/2008 | Tanada | |
| 2005/0051817 | A1* | 3/2005 | Morita et al. | 257/294 |
| 2010/0277449 | A1* | 11/2010 | Kanda | 345/206 |
| 2011/0069094 | A1* | 3/2011 | Knapp | 345/690 |

FOREIGN PATENT DOCUMENTS

JP 2000-155538 A 6/2000

* cited by examiner

*Primary Examiner* — Lixi C Simpson
(74) *Attorney, Agent, or Firm* — Canon USA, Inc. IP Division

(57) ABSTRACT

A display apparatus includes a plurality of light emitting elements, a plurality of driving circuits connected to first electrodes of the respective light emitting elements, and a plurality of power supply lines connected to second electrodes of the light emitting elements. A set of light emitting elements that emit light of colors different from each other are connected such that the first electrodes of these light emitting elements are connected in common to one of the driving circuits, and the second electrodes of these light emitting elements are separately connected to the plurality of the power supply lines. The light emitting elements whose second electrodes are connected to one of the power supply lines include light emitting elements configured to emit light of different colors.

13 Claims, 20 Drawing Sheets

| FIRST FIELD | | | |
|---|---|---|---|
| R | G | B | R |
| R | G | B | R |
| R | G | B | R |
| R | G | B | R |

| SECOND FIELD | | | |
|---|---|---|---|
| G | B | R | G |
| G | B | R | G |
| G | B | R | G |
| G | B | R | G |

| THIRD FIELD | | | |
|---|---|---|---|
| B | R | G | B |
| B | R | G | B |
| B | R | G | B |
| B | R | G | B |

DISPLAY APPARATUS AND DRIVING METHOD FOR THE SAME

BACKGROUND OF THE INVENTION

1. Field of the Invention

The present method relates to a display apparatus, and more particularly, to a display apparatus configured to display a color image by driving light emitting elements of different colors to emit light in a time division manner and a method of driving such a display apparatus.

2. Description of the Related Art

One method of displaying a color image is to prepare an array of three types of light emitting elements each configured to emit light of one of R (red), G (green), and B (blue) colors and drive these light emitting elements at the same time to obtain an image with a mixture of colors. This method is widely used to display a color image.

U.S. Pat. No. 7,403,177 discloses another method in which three colors are sequentially emitted in each pixel repeatedly in a short time such that colors are mixed temporally. This method is known as a time-division driving method.

In the time-division driving method, R, G, and B colors are sequentially emitted in each pixel and thus it is possible to share a driving circuit. An organic electroluminescent element may be used as light emitting element. Organic electroluminescent elements of three colors of R, G, and B may be formed one on another into a multilayer structure, and electrodes may be disposed on the top and bottom of the multilayer structure and in an intermediate layer thereof such that the organic electroluminescent elements can be independently driven. This structure allows light of each color to be emitted over the entire area of each pixel.

In the time-division driving method disclosed in U.S. Pat. No. 7,403,177, R, G, and B light emitting elements are driven while temporally switching these light emitting elements. To this end, a switch is disposed between a driving circuit and electrodes of the light emitting elements. U.S. Pat. No. 5,748,160 discloses a technique in which the above-described switch is removed, and, instead, a driving circuit is connected in common to electrodes of R, G, and B light emitting elements and a voltage is applied to opposite electrodes that are separately provided for the respective R, G, and B light emitting elements such that timing of applying the voltage is sequentially shifted to emit light sequentially by the R, G, and B light emitting elements. That is, the voltage is applied to the opposite electrodes of the R, G, and B light emitting elements at different times. To represent a halftone image, a frame may be divided into sub-frames and the applied voltage may be changed stepwise. If R, G, and B images are displayed sequentially in time, an edge of an object in a moving picture is colored when seen by human eyes. This phenomenon is known as color break-up. Because the color break-up is caused by displaying R, G, and B images at different times, the color break-up also occurs when each period of displaying one of R, G, and B images is divided into sub-frames to represent halftone.

SUMMARY OF THE INVENTION

In an aspect, the present invention provides an apparatus includes a plurality of light emitting elements configured to emit light of colors assigned to respective light emitting elements by providing currents flowing between first and second electrodes, a plurality of driving circuits connected to the first electrodes of the light emitting elements to supply currents thereto, and a plurality of power supply lines connected to the second electrodes of the light emitting elements to supply voltages to the second electrodes. A set of the light emitting elements that emit light of colors different from each other are connected such that the first electrodes are connected in common to one of the driving circuits, and the second electrodes are separately connected to the plurality of the power supply lines, and the light emitting elements whose second electrodes are connected to one of the power supply lines include light emitting elements configured to emit light of different colors.

In an aspect, the present invention provides a method of driving the display apparatus, including applying a voltage, that causes light emitting elements to turn on to emit light, to one of the power supply lines and applying a voltage, that causes light emitting elements to turn off to emit no light, to the other power supply lines, wherein applying the voltages is performed sequentially for the plurality of power supply lines.

The invention may be applied to an emissive display such as an organic electroluminescent element. The display apparatus may be a stand-alone display such as a television receiver capable of receiving a television broadcast wave and displaying an image thereof, or the display apparatus may be embedded in another apparatus such as a digital camera.

Further features of the present invention will become apparent from the following description of exemplary embodiments with reference to the attached drawings.

DESCRIPTION OF THE EMBODIMENTS

A light emitting element such as an organic electroluminescent element has a diode characteristic in which a current flows only in one direction to emit light. If one of two electrodes i.e., an anode or a cathode is connected to a current source (hereinafter this electrode is referred to as a first electrode) and the other electrode (hereinafter referred to as a second electrode) is applied with a voltage sufficiently lower than the voltage of the current source, a current flows through the light emitting element. When the voltage applied to the second electrode is higher than the current source voltage applied to the first electrode, no current flows. This means that it is possible to turn on and off the current by controlling the voltage applied to the second electrode.

A screen of a display apparatus includes a plurality of pixels. Each pixel includes light emitting elements of different colors, which may be three colors of R (red), G (green), and B (blue) or may be a combination of other and/or additional colors. First electrodes of these light emitting elements are connected together to a driving circuit serving as a current source, while the second electrode of each light emitting element is separately formed and is individually applied with a voltage. The second electrode formed separately for each light emitting element is connected to second electrodes of light emitting elements of the same color or different colors in other pixels such that the same voltage can be applied at the same time to the second electrode of all pixels. By controlling the voltage of the second electrode, it is possible to emit light from one light emitting element of each pixel while turning off the other light emitting elements. By switching the active light emitting element sequentially, it is possible to switch the color of the image being displayed. If the switching is performed repeatedly at a high speed, the resultant image can be seen by human eyes as an image including a mixture of colors.

The present invention is described in further detail below with reference to specific embodiments in conjunction with the accompanying drawings. In embodiments described below, by way of example, an organic electroluminescent element is used as a light emitting element, although the light emitting element is not limited to the organic electroluminescent element. It is also assumed that an anode is a first electrode connected to a driving circuit and a cathode is a second electrode. Note that a cathode of an organic electroluminescent element may be a first electrode and an anode thereof may be a second electrode, and a current may be supplied in an opposite direction.

First Embodiment

Figure 1:
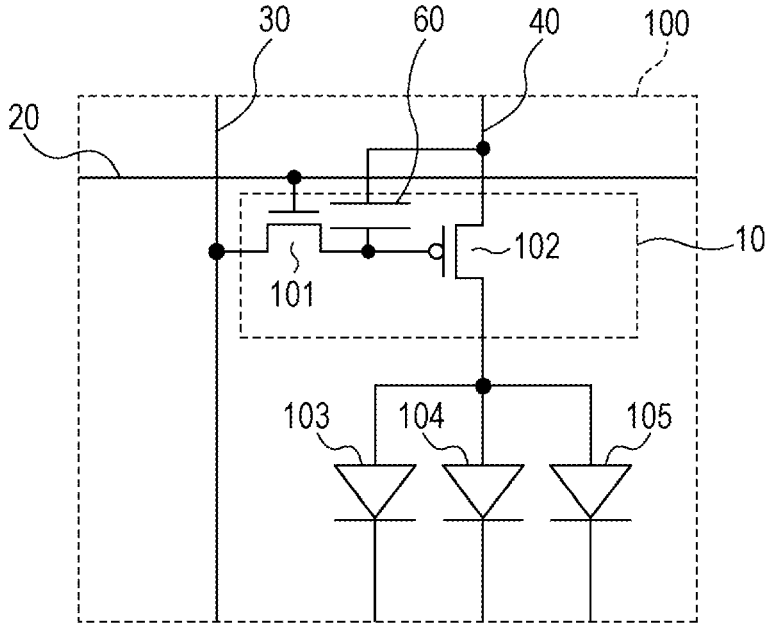
FIG. 1 is a diagram illustrating organic electroluminescent elements and a driving circuit thereof in a display apparatus according to an embodiment of the present invention.

FIG. 1 is a circuit diagram illustrating one pixel of a display apparatus according to a first embodiment of the invention. The pixel 100 has a driving circuit 10 including a selection transistor 101, a driving transistor 102, and a storage capacitor 60 connected between the gate and the source of the driving transistor 102. The drain of the selection transistor 101 is connected to a data line 30, and the source of the selection transistor 101 is connected to the gate of the driving transistor 102 and also to one end of the storage capacitor 60. The selection transistor 101 functions as a switch that connects the data line 30 to the gate electrode of the driving transistor 102. A signal for selecting pixels in units of rows is input via selection line 20 to the gate of the selection transistor 101 thereby controlling turning-on/off of the selection transistor 101. The driving transistor 102 is of a P channel type. The source of the driving transistor 102 is connected to a current supply line 40, and the drain of the driving transistor 102 is connected in common to anodes of three organic electroluminescent elements 103 to 105. When the selection transistor 101 turns on, a data signal is transferred from the data line 30 and stored by the storage capacitor 60. In this situation, the gate-source voltage of the driving transistor 102 is given by the voltage stored in the storage capacitor 60. Thus the drain current of the driving transistor 102 is determined by this voltage and output as a driving current from the driving circuit 10.

Cathodes of the three organic electroluminescent elements 103 to 105 are separately connected to respective cathode wirings 203 to 205 described below.

Although in the example shown in FIG. 1, the anodes of the organic electroluminescent elements are connected in common to the driving circuit, the anodes and the cathodes may be disposed at opposite locations. In this case, the voltage polarity of the power supply line is reversed and an N-channel transistor is used as the driving transistor 102 such that a current flows in an opposite direction.

The driving circuit 10 for driving the organic electroluminescent elements is not limited to that shown in FIG. 1, but many other driving circuits may be used as long as they are configured such that the driving circuit is connected to the selection line 20 and the data line 30, signals are supplied via the selection line 20 and the data line 30, a data signal supplied via the data line 30 is captured and held in accordance with the signal supplied via the selection line 20, and a current or a voltage is generated according to the held data signal and output to the organic electroluminescent elements 103 to 105. The selection line 20 connected to the driving circuit 10 is not limited to a single line, but additional one or more selection lines may be provided to control light emission periods of the organic electroluminescent elements 103 to 105. Any such driving circuit may be used in embodiments of the invention.

A display apparatus is configured such that pixels similar to that shown in FIG. 1 are arranged in the form of a matrix including 1920 (=640×3) pixel in a horizontal direction and 480 pixels in a vertical direction. The display apparatus may include a power supply line that is disposed in an outward area of the display unit in which the pixels are arranged and that is configured to supply a current or a voltage to each pixel, and a driver and a control unit that are also disposed in an outward area and that are configured to drive signal lines and generate and process a display signal.

Figure 2:
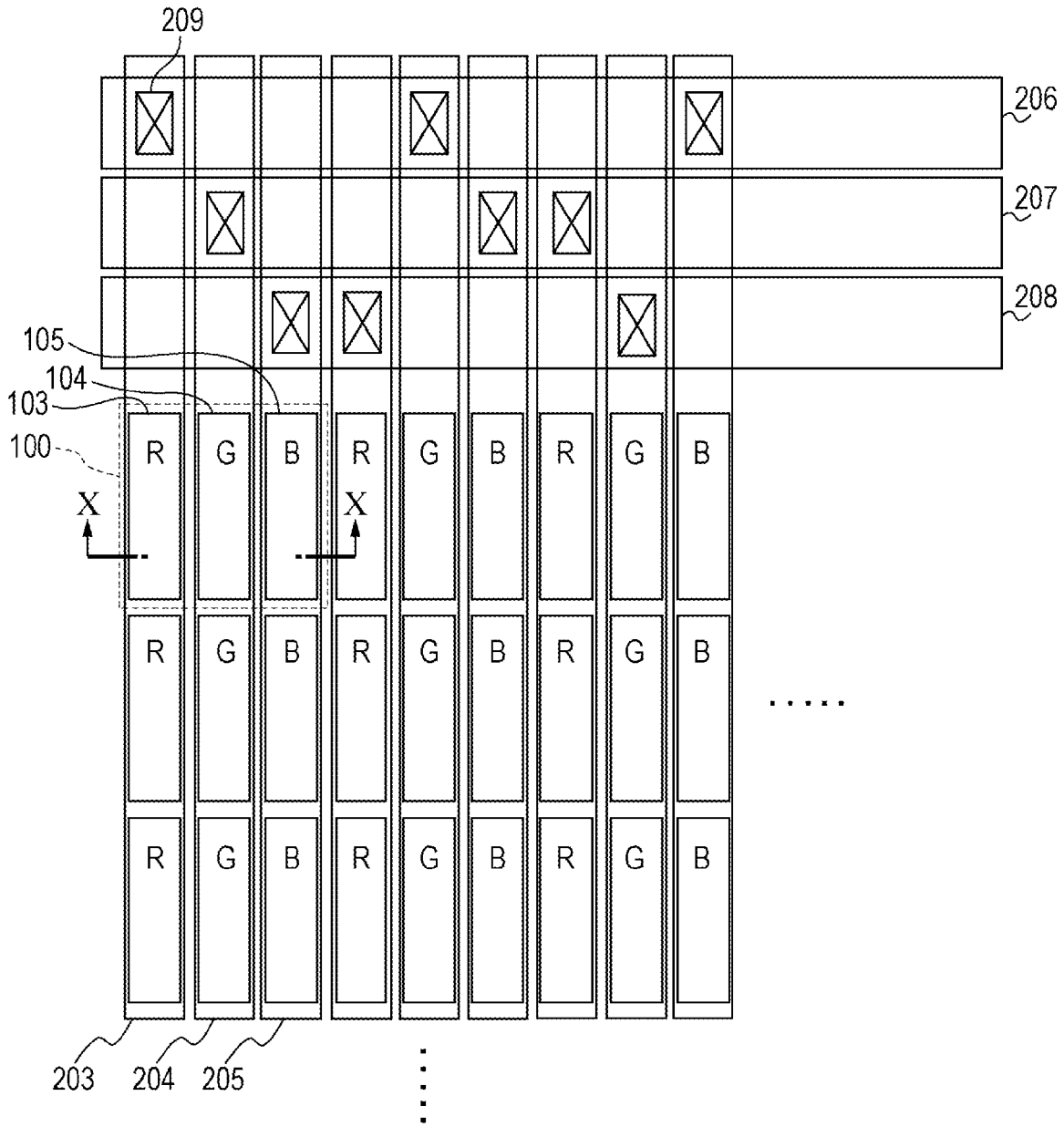
FIG. 2 is a diagram illustrating organic electroluminescent elements and cathode wirings in a display apparatus according to an embodiment of the present invention.

FIG. 2 is a diagram illustrating a manner in which organic electroluminescent elements of three colors of R, G, and B and cathode lines are arranged. Each pixel 100 is divided into three areas. An organic electroluminescent element 103 configured to emit red (R) light is disposed in one area, an organic electroluminescent element 104 configured to emit green (G) light is disposed in another area, and an organic electroluminescent element 105 configured to emit blue (B) light is disposed in the other area. Organic electroluminescent elements are arranged periodically in the same manner for all pixels.

The number of light emitting elements forming one pixel and the combination of colors are not limited to those employed in the example described above in which each pixel includes one R light emitting element, one G light emitting element, and B light emitting element. Each pixel may include two or more light emitting elements. The number of light emitting elements disposed in each pixel is the same for all pixels. Each pixel is configured to include a plurality of light emitting elements to emit at least different colors. In the display apparatus, two or more light emitting elements disposed in one pixel may emit light of the same color. If the same current or the same voltage is applied to a plurality of light emitting elements and they emit light simultaneously, then they can be regarded as one light emitting element. However, when a plurality of light emitting elements of the same color are formed such that electrodes are separately provided therefor and they are driven individually by different signals, then these light emitting elements are regarded as different light emitting elements.

The cathodes of the three RGB organic electroluminescent elements 103 to 105 in each pixel 100 are isolated and extend in a direction perpendicular to a direction in which different colors are arranged, i.e., the cathodes extend in a vertical direction in FIG. 2 in the form of stripe-shaped cathode wirings 203 to 205. The three cathode wirings 203 to 205 are in respective columns of the pixel 100.

The cathode wirings 203 to 205 are connected such that cathodes of organic electroluminescent elements of the same color in pixels 100 at adjacent upper and lower locations are connected together. In FIG. 2, the cathode wirings 203 to 205 extend in the same direction as the direction in which data lines 30 extend.

The cathode wirings 203 to 205 extends into an area outside a display area in which the pixels 100 are arranged in the form of a matrix, and the cathode wirings 203 to 205 are respectively connected to corresponding one of three power supply lines 206 to 208. In the outside of the pixel array area, the power supply lines 206 to 208 are selectively connected to one of the cathode wirings 203 to 205 of the pixels. Thus three systems of wirings are formed such that each wiring system includes one of the cathode wirings 203 to 205 and one of the power supply lines 206 to 208 whereby the cathode of each of the organic electroluminescent elements in each pixel is connected to the cathode of one of the organic electroluminescent elements in another pixel for all pixels. That is, the cathodes of the respective organic electroluminescent elements 103 to 105 in one pixel 100 are separately connected to respective three cathodes in another pixel for all pixels.

In the present embodiment, the power supply line 206 is connected to the R cathode wiring 203 in the first column, the G cathode wiring 204 in the second column, and the B cathode wiring 205 in the third column. The power supply line 207 is connected to the G cathode wiring 204 in the first column, the B cathode wiring 205 in the second column, and the R cathode wiring 203 in the third column. The power supply line 208 is connected to the B cathode wiring 205 in the first column, the R cathode wiring 203 in the second column, and the G cathode wiring 204 in the third column. In columns following the third column, connections are made in a similar manner every three columns.

That is, each of the power supply lines 206 to 208 is connected such that one color is selected from each column and such that selected colors are different for successive three columns.

Figure 3:
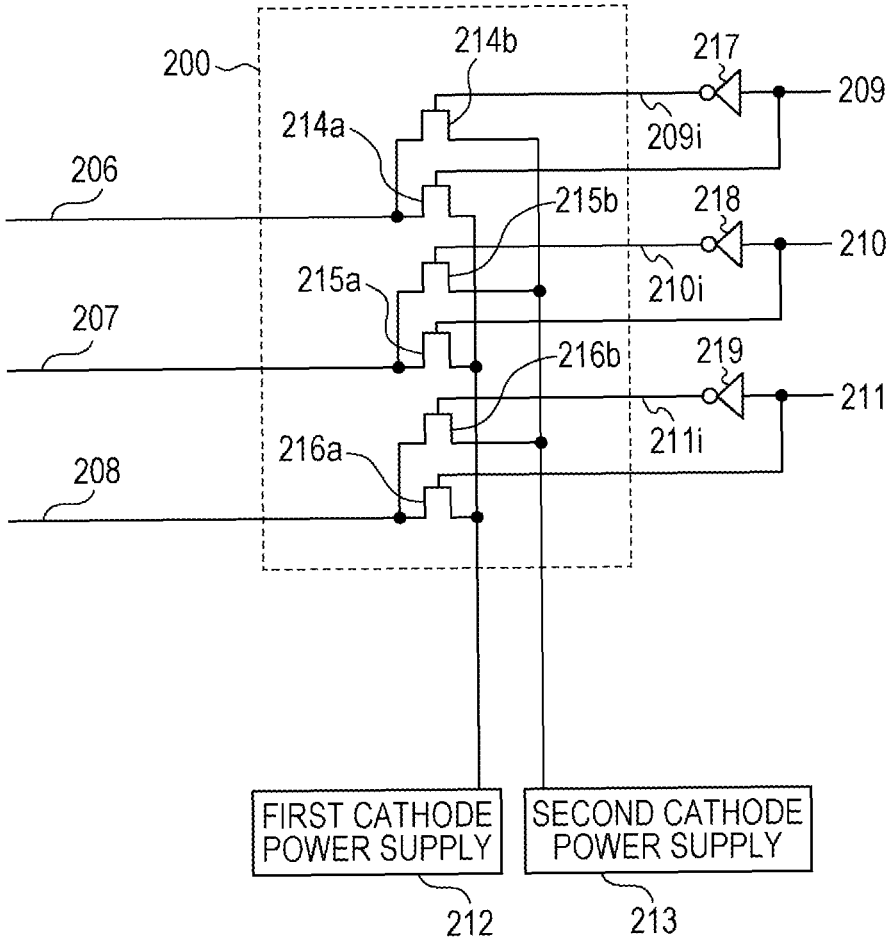
FIG. 3 is a diagram illustrating switch circuits of power supply lines in a display apparatus according to an embodiment of the present invention.

FIG. 3 illustrates a switch circuit 200 configured to switch power supply voltages applied to the power supply lines 206 to 208.

The power supply line 206 is connected to a pair of voltage sources 212 and 213 via two switches 214*a* and 214*b*. The switch 214*a* is controlled by a signal 209, while the switch 214*b* is controlled by an inverted signal 209*i* produced by inverting the signal 209 by an inverter 217 such that the switches 214*a* and 214*b* operate in a complementary manner, i.e., in such a manner that when one of them is in an ON state, the other one is in an OFF state.

Similarly, the power supply lines 207 and 208 are connected to the same pair of voltage sources 212 and 213 via two switches 215*a* and 215*b* or 216*a* and 216*b*. The switch 215*a* is controlled by a signal 210, while the switch 215*b* is controlled by an inverted signal 210*i* produced by inverting the signal 210 by an inverter 218 such that the switches 215*a* and 215*b* operate in a complementary manner. The switch 216*a* is controlled by a signal 211, while the switch 216*b* is controlled by an inverted signal 211*i* produced by inverting the signal 211 by an inverter 219 such that the switches 216*a* and 216*b* operate in a complementary manner.

The first cathode power supply 212 outputs a first voltage V1 sufficiently lower than a potential Vcc of the current supply line 40 of the driving circuit 10. The second cathode power supply 213 outputs a second voltage V2 sufficiently higher than the potential Vcc of the current supply line 40. As described below, when the first voltage V1 is supplied to the cathodes of the organic electroluminescent elements 103 to 105, a forward bias voltage is applied between the two electrodes of each organic electroluminescent element and the organic electroluminescent element emits light. On the other hand, when the second voltage V2 is supplied to the pixel, a reverse bias voltage is applied between the two electrodes of each organic electroluminescent element and thus no light is emitted by the organic electroluminescent element. Hereinafter, V1 is referred to a light emission level and V2 is referred to as a no-light emission level.

Figure 4:
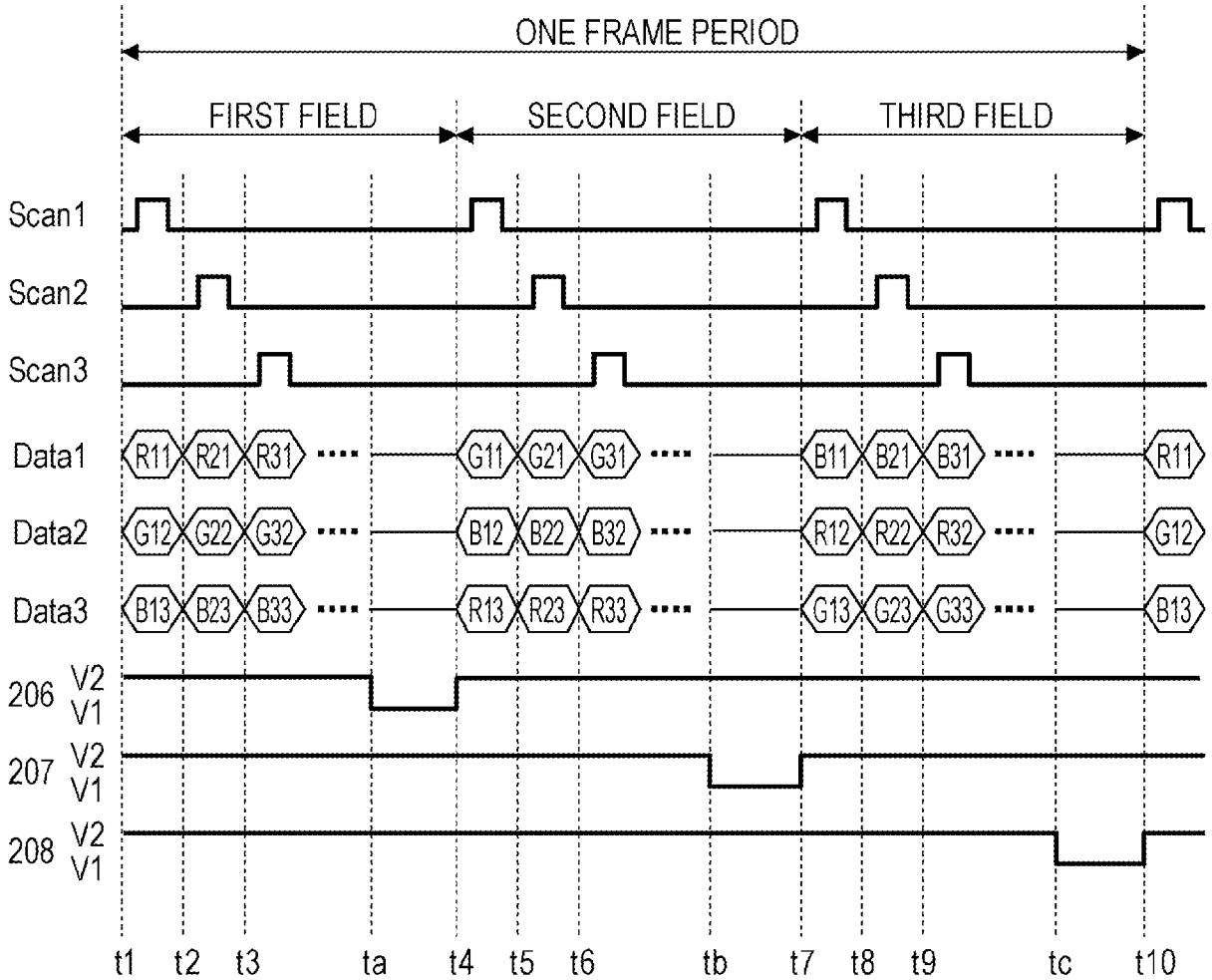
FIG. 4 is a timing chart illustrating an operation of a display apparatus according to an embodiment of the present invention.

FIG. 4 is a timing chart associated with signal voltages of respective signal lines. A period from time t1 to time t10 is a period in which one image is displayed, and this period is referred to as one frame period. One frame period includes three fields, i.e., first, second, and third fields.

In the first field from time t1 to time t4, data writing is first performed in a period from t1 to ta. The first, second, third, and following rows are sequentially selected at t1, t2, t3, . . . and so on, and control signals Scan1, Scan2, Scan3, . . . and so on are applied to the selection line 20. In synchronization with the control signals, data signals Data1, Data2, Data3 and so on are applied to data lines 30 in the respective columns. The control signal Scan1 is set to the selection potential in a period from t1 to t2 and data signals Data1=R11, Data2=G12 and Data3=B13 (following this, data signals are related to colors in the same order) are captured by pixels in the first row. These data signals are held as voltages in parasitic capacitance existing between the gate and the source of the driving transistor 102.

The control signal Scan2 is set to the selection potential in a period from t2 to t3 and data signals Data1=R21, Data2=G22, and Data3=B23 are held in the pixel circuits in the second row. Data signals are written in a similar manner for the following rows, and writing is complete for all rows at time ta. In the first field, data signals are written in pixels such that an R data signal is written in the first column, a G data signals is written in the second column, and a B data signal is written in the third column. In the following columns, data signals are written in a similar manner.

After the writing is completed for all rows, in a remaining period from ta to t4 of the first filed, the control signal 209 goes to the selection level (low level), the switch 214*a* turns on, and the switch 214*b* turns off. The control signals 210 and 211 are in the non-selection level (high level), the switches 215*a* and 216*a* are in the OFF state, and the switches 215*b* and 216*b* are in the ON state.

As a result, the power supply line 206 is switched to the light emission level V1, and thus the cathode wirings 203, connected therewith, of organic electroluminescent elements of each pixel column are switched to the light emission level V1. Because the power supply lines 207 and 208 are maintained in the state of being connected with the power supply 213, the potential of the cathode wiring 204 of G organic electroluminescent elements and the potential of the cathode wiring 205 of B organic electroluminescent elements in each column are at the no-light emission level V2. Therefore, in the first column, the forward bias voltage is applied only to R (red) organic electroluminescent elements 103 and light is emitted thereby depending on the held signal voltages. However, no light is emitted by the G (green) organic electroluminescent elements 104 and the B (blue) organic electroluminescent elements 105 in the first column because they are reversely biased. In the second column, light is emitted by G (green) organic electroluminescent elements. In the third column, light is emitted by B (blue) organic electroluminescent elements.

At time t4, the power supply line 206 is switched to the no-light emission level V2, and thus all organic electroluminescent elements are brought into the no-light emission state and the first field period is ended.

At time t4, the second field period starts, and the control signals Scan1, Scan2, . . . are sequentially switched to the selection potential at times t4, t5, t6, . . . in a similar manner to the first field. In synchronization with the control signals, data signals Data1=G11, G21, G31, . . . are captured from the data line in the first column, data signals Data2=B12, B22, B32, . . . are captured from the data line in the second column, and data signals Data3=R13, R23, R33, . . . are captured from the data line in the third column. These data signals are transferred to the pixels as signals that define the light emission luminance of the G (green) organic electroluminescent elements 104.

In a period from t4 to tb, the green data signals are written in all pixels. In a remaining period from tb to t7 in the second field period, the control signal 210 is switched to the selection potential. As a result, the power supply line 207 and the cathode wiring 204 are switched to the light emission level V1. The control signals 209 and 211 are maintained at the non-selection potential, and thus the power supply lines 206 and 208 and the cathode wirings 203 and 205 are set to the no-light emission level V2. As a result, the forward bias voltage is applied to G (green) organic electroluminescent elements in the first column, B (blue) organic electroluminescent elements in the second column, and R (red) organic electroluminescent elements in the third column, whereby light is emitted by these organic electroluminescent elements.

In the third field from time t7 to t10, the operation is performed in a similar manner such that data is written at times t7, t8, t9, . . . and light is emitted in a period from time tc to t10 such that blue light is emitted in the first column, red light in the second column, and green light in the third column.

Figures 5A, 5B:
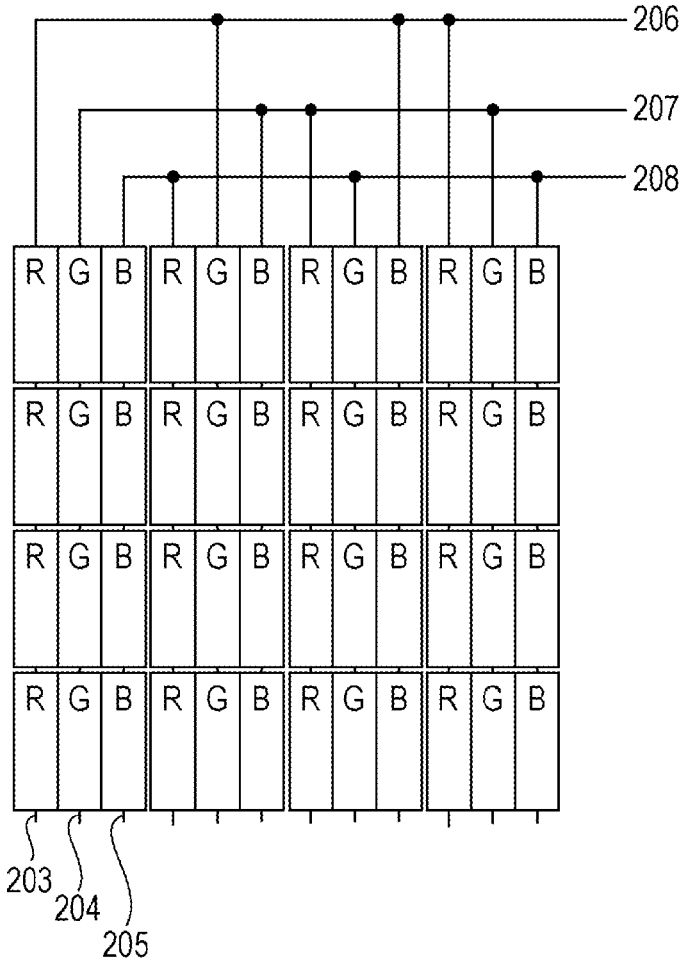
FIG. 5A is a diagram illustrating a layout of organic electroluminescent elements according to an embodiment of the present invention.
FIG. 5B is a diagram illustrating colors emitted by organic electroluminescent elements in each field.

FIG. 5A illustrates connections of cathode wirings, and FIG. 5B illustrates a manner in which light is emitted in each of the first to third fields. In FIG. 5A, the cathode wirings and the power supply lines are connected in the same manner as in FIG. 3. In FIG. 5B, a symbol R is used to indicate pixels in which R (red) organic electroluminescent elements are activated to emit light, a symbol G is used to indicate pixels in which G (green) organic electroluminescent elements are activated to emit light, and a symbol B is used to indicate pixels in which B (blue) organic electroluminescent elements are activated to emit light. In the first field, light emission is performed in the manner of RGBR . . . from the leftmost column to right. In the second field, light emission is performed in the manner of GBRG . . . from the leftmost column to right. In the third field, light emission is performed in the manner of BRGB . . . from the leftmost column to right. In each pixel, red, green, and blue organic electroluminescent elements are sequentially activated to emit light in turn from one field to another in the three fields in each frame period. Light emission is repeated in this manner every 1/60 seconds.

In each field, light is emitted at the same time for all columns such that R, G, and B colors repeatedly appear every three columns. R, G, and B colors in three columns are cyclically exchanged from one filed to another in three fields. Note that in each field, colors are different between pixels that are adjacent in the row direction. In a case where displaying an image is controlled such that all pixels have the same color over a whole screen, color break-up can occur, i.e., edges of moving objects are colored when viewed by human eyes. However, in the present embodiment, an image includes all three colors in any field, and thus color break-up does not occur except for a special case in which white appears every three columns.

Second Embodiment

Figure 6A:
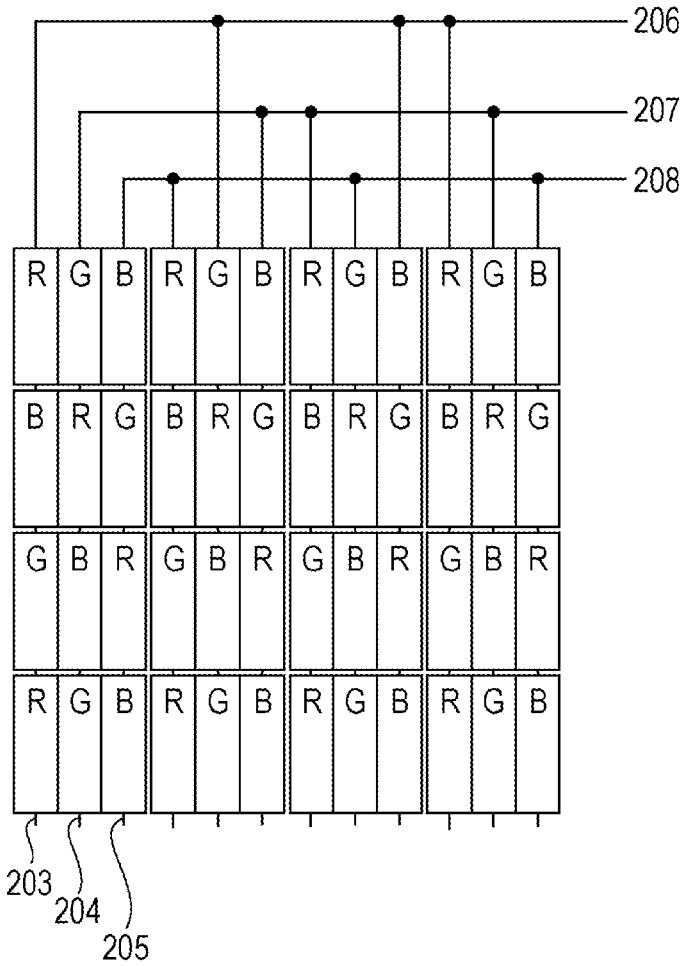
FIG. 6A is a diagram illustrating a layout of organic electroluminescent elements according to an embodiment of the present invention.

FIG. 6A illustrates a manner in which pixels are arranged in the form of a matrix and illustrates a manner in which cathode wirings are connected according to a second embodiment of the present invention. In this arrangement, unlike that shown in FIG. 5A, RGB color locations are shifted to right by one column from one row to another in a downward direction. The cathode wirings and the power supply lines are connected in the same manner as in the first embodiment. That is, the power supply line 206 is connected to the R cathode wiring 203 in the first column, the G cathode wiring 204 in the second column, and the B cathode wiring 205 in the third column. The power supply line 207 is connected to the G cathode wiring 204 in the first column, the B cathode wiring 205 in the second column, and the R cathode wiring 203 in the third column. The power supply line 208 is connected to the B cathode wiring 205 in the first column, the R cathode wiring 203 in the second column, and the G cathode wiring 204 in the third column. In columns following the third column, connections are made periodically every three columns in a similar manner.

Figure 7:
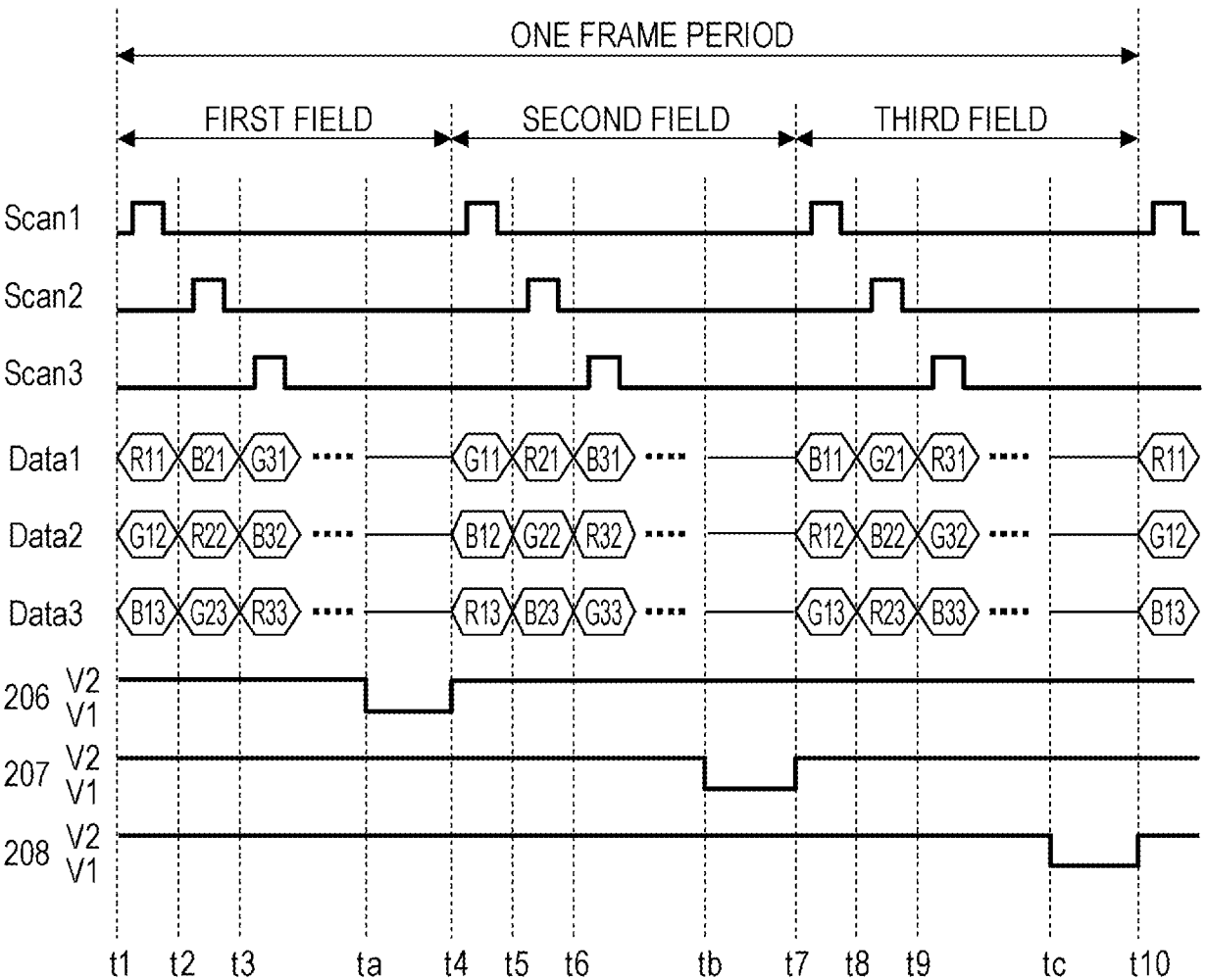
FIG. 7 is a timing chart illustrating an operation of a display apparatus according to an embodiment of the present invention.

Data signals are supplied in the same manner in terms of the columns and the order as in the first embodiment. FIG. 7 illustrates a timing chart associated with the operation. Organic electroluminescent elements do not have the same color in each column, and thus, unlike FIG. 4, a mixture of RGB data signals is applied to each column in each field. That is, in the first field, data signals are supplied sequentially with time such that data signals Data1=R11, B21, G31, . . . are supplied to the data line in the first column, data signals Data2=G12, R22, B32, . . . are supplied to the data line in the second column, and data signals Data3=B13, G23, R33, . . . are supplied to the data line in the third column. In the second field, the order R→B→G employed in the first field in supplying data signals to columns is changed into order G→R→B, and further changed into the order of B→G→R in the third field.

Figure 6B:
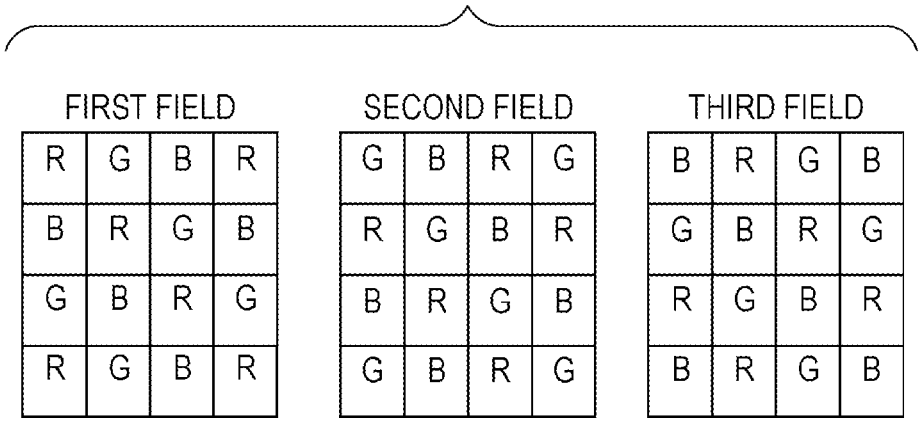
FIG. 6B is a diagram illustrating colors emitted by organic electroluminescent elements in each field.

As a result, respective pixels emit light of colors in each field as shown in FIG. 6B. Because shifting of RGB color locations occurs from one row to another, RGB colors are mixed not only in the row direction but also in the column direction in each field. In the arrangement according to the first embodiment described above, colors are the same in each column, and thus color break-up can occur when an edge of an image extending in a vertical direction (column direction) moves. In contrast, in the arrangement shown in FIG. 6A, color break-up does not occur in any image.

Third Embodiment

Figure 8A:
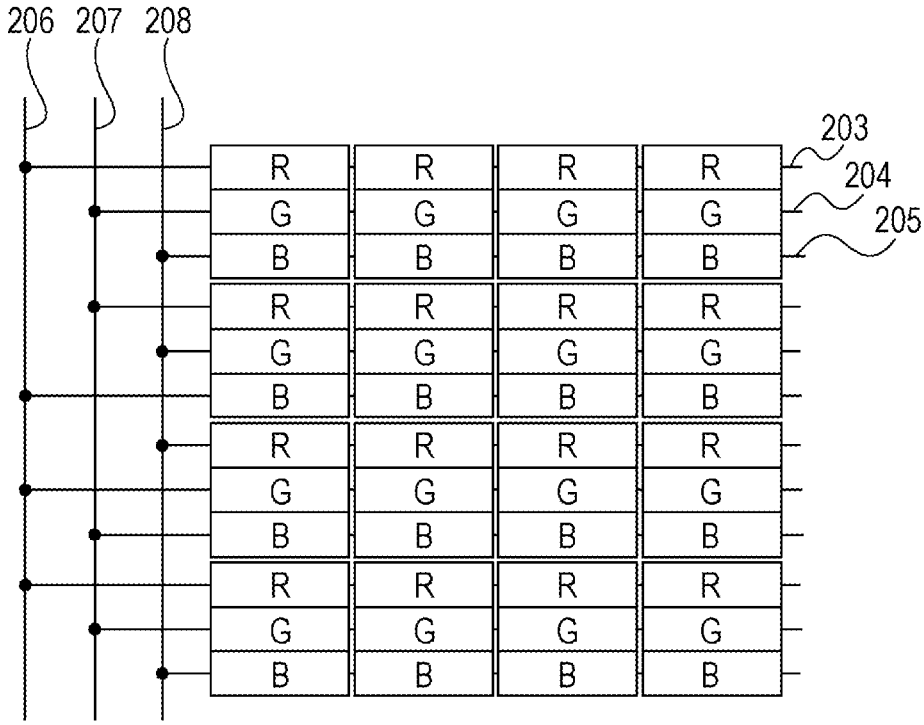
FIG. 8A is a diagram illustrating a layout of organic electroluminescent elements according to an embodiment of the present invention.

FIG. 8A illustrates a manner of connecting cathode wirings in a display apparatus in which organic electroluminescent elements of three colors are arranged periodically in the order of R, G, and B in a vertical direction. The cathode of each pixel is divided into three pieces in a vertical direction (in a column direction) and cathode wirings 203 to 205 are formed such that each cathode wiring extends in a horizontal direction (in a row direction) perpendicular to a direction in which colors are changed periodically. Power supply lines 206 to 208 are formed so as to extend in a vertical direction (in a column direction) in an area at a left side of the pixel array. As in the first and second embodiments, selection lines 20 and data lines 30 are formed so as to extend in row and column directions, respectively. A driving circuit is formed in each pixel in the same manner as that shown in FIG. 1.

Each of the power supply lines 206 to 208 is connected to one of the three cathode wirings 203 to 205 in each row such that one color is selected from each row and such that selected colors are different for successive three rows. The cathode wirings 203 to 205 are connected to the power supply lines 206 to 208 in a similar manner to the first and second embodiments except that rows and columns are exchanged.

Figure 9:
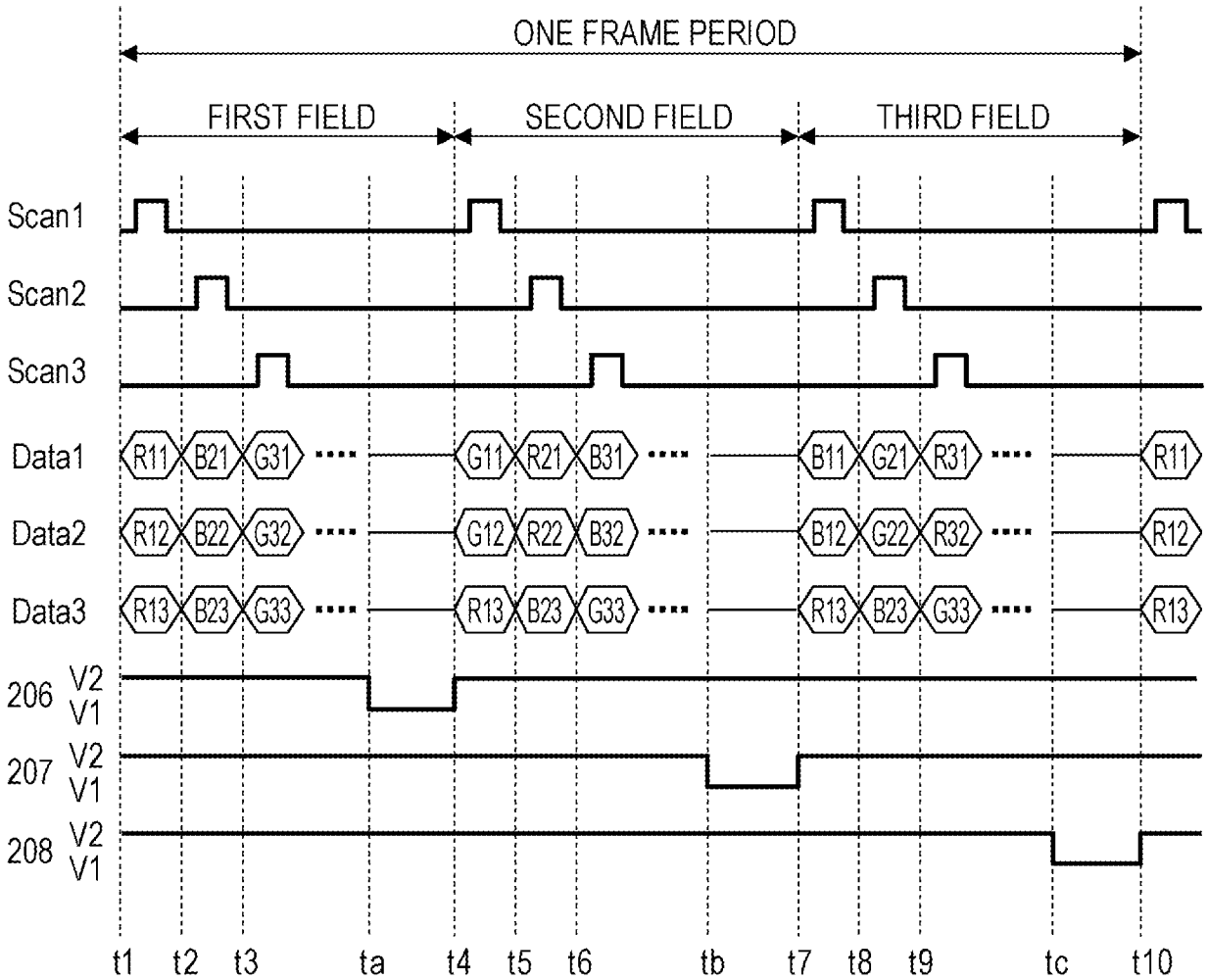
FIG. 9 is a timing chart illustrating an operation of a display apparatus according to an embodiment of the present invention.

FIG. 9 illustrates a timing chart associated with the operation according to the present embodiment. Data signals Data1, Data2, Data3, . . . are supplied to the data lines 30 in the respective columns as follows. In the first field, Data1=R11, B21, G31, . . . , Data2=R12, B22, G32, . . . , Data3=R13, B23, G33, . . . and so on are supplied in the periodic order R→B→G in the column direction. In the second field, Data1=G11, R21, B31, . . . , Data2=G12, R22, B32, . . . , Data3=G13, R23, B33, . . . and so on are supplied in the periodic order G→R→B in the column direction. In the third field, Data1=B11, G21, R31, . . . , Data2=B12, G22, R32, . . . , Data1=B13, G23, R33, . . . and so on are supplied in the periodic order B→G→R in the column direction.

Figure 8B:
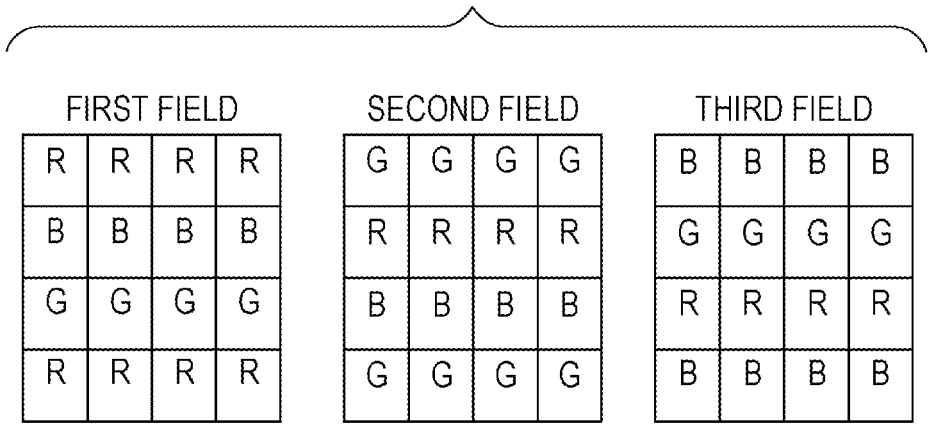
FIG. 8B is a diagram illustrating colors emitted by organic electroluminescent elements in each field.

FIG. 8B illustrates colors emitted by respective pixels in each field. Because the cathode wirings 203 to 205 are connected to pixels in common in the row direction, the color is the same along each row in each field. However, RGB colors are mixed in the column direction. This prevents color break-up from occurring, that is, a vertical edge of an image is prevented from being colored in green.

In the present embodiment, organic electroluminescent elements are arranged in the form of stripes in the row direction such that organic electroluminescent elements in each stripe have the same color. Thus, as with the arrangement shown in FIG. 5A according to the first embodiment, the arrangement according to the present embodiment makes it easy to perform a process of forming color filters or performing selectively RGB evaporation using a metal mask.

Figure 10:
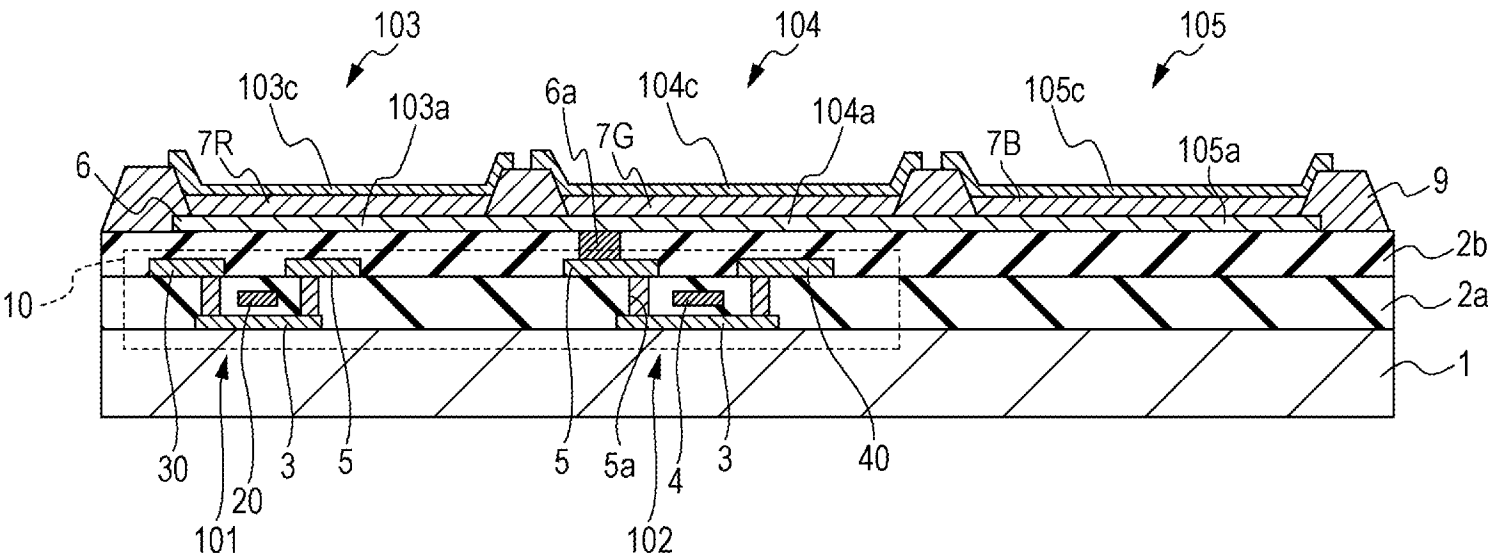
FIG. 10 is a diagram illustrating a cross-sectional structure of an organic electroluminescent element in a display apparatus according to an embodiment of the present invention.

FIG. 10 is a cross-sectional view taken along a dotted line X-X in FIG. 2. In FIG. 10, similar parts to those in FIG. 1 are denoted by similar reference numerals.

The organic electroluminescent elements 103 to 105 respectively include anodes 103*a* to 105*a*, organic light emitting layers 7R, 7G, and 7B, and cathodes 103*c* to 105*c* such that light is emitted by a current flowing from an anode to a cathode. The selection transistor 101 and the driving transistor 102 are formed on a substrate 1, and each transistor has a semiconductor layer 3 connected to a source/drain electrode via a contact hole 5*a* formed in an insulating layer 2*a*. The source electrode of the selection transistor 101 is connected to the data line 30. The drain electrode 5 of the selection transistor 101 is connected to the gate electrode 4 of the driving transistor 102 via a wiring that is not shown in the figure. The current supply line 40 functions as the source electrode of the driving transistor 102. The drain electrode 5 of the driving transistor 102 is connected to the anode 6 of the organic electroluminescent element via the contact hole 5*a* formed in a second insulating layer 2*b*. In FIG. 10, the anodes 103*a* to 105*a* of the respective organic electroluminescent elements 103 to 105 are formed by a single plate of electrode 6 and such that they are connected together. The driving circuit 10 of the organic electroluminescent elements 103 to 105 is formed by the selection transistor 101, the driving transistor 102, and the gate electrodes and sour/drain electrodes thereof. In addition, a capacitor for storing a data signal may be formed.

The cathodes 103*c* to 105*c* are formed by a transparent electrode made of ITO (indium tin oxide) or the like. The separate cathodes 103*c* to 105*c* may be formed by forming an ITO film on the whole surface by using evaporation or sputtering and then cutting the ITO film into a plurality of pieces by irradiation of laser light. Alternatively, a metal mask may be used to achieve patterning. Still alternatively, patterning may be performed using an inverse-tapered pixel isolation film, or other similar processes may be used. In the example shown in FIG. 10, each pixel may be formed by three organic electroluminescent elements configured to emit light of R (red), G (green), and B (blue) colors. Alternatively, RGB color filters may be put on organic electroluminescent elements configured to emit light of white color. Each pixel including three arranged organic electroluminescent elements may be formed by evaporating a light emitting material via a metal mask. Alternatively, RGB organic electroluminescent layers may be formed by using a laser transfer process from a substrate on which an organic electroluminescent material is coated.

The organic electroluminescent element 103 has a structure in which the organic light emitting layer 7R is disposed between the anode 103*a* and the cathode 103*c*. In FIG. 10, the organic light emitting layer 7R is illustrated as being in the form of one layer. However, actually, the organic light emitting layer 7R includes three layers, i.e., a hole injection/transport layer, a light emitting layer, and an electron injection/transport layer formed in this order from the bottom to the top. The hole injection/transport layer is a semiconductor layer including holes as majority carriers, while the electron injection/transport layer is a semiconductor layer including electrons as majority carriers.

The organic electroluminescent elements 104 and 105 also have a similar structure although there are differences in materials of the organic light emitting layers and thicknesses of respective layers.

When a voltage (a forward bias voltage) is applied across the organic electroluminescent element 103 such that its anode has a higher potential than the cathode, holes are injected from the hole injection layer into the light emitting layer and electrodes are injected from the electron injection layer into the light emitting layer. When the injected holes and electrons recombine in the light emitting layer, light is emitted. In a case where a voltage (a reverse bias voltage) is applied reversely such that the anode has a lower potential than the cathode, no carries are injected and no light is emitted. As described above, the organic electroluminescent element has a rectifying characteristic similar to that of a diode.

Fourth Embodiment

Figure 11:
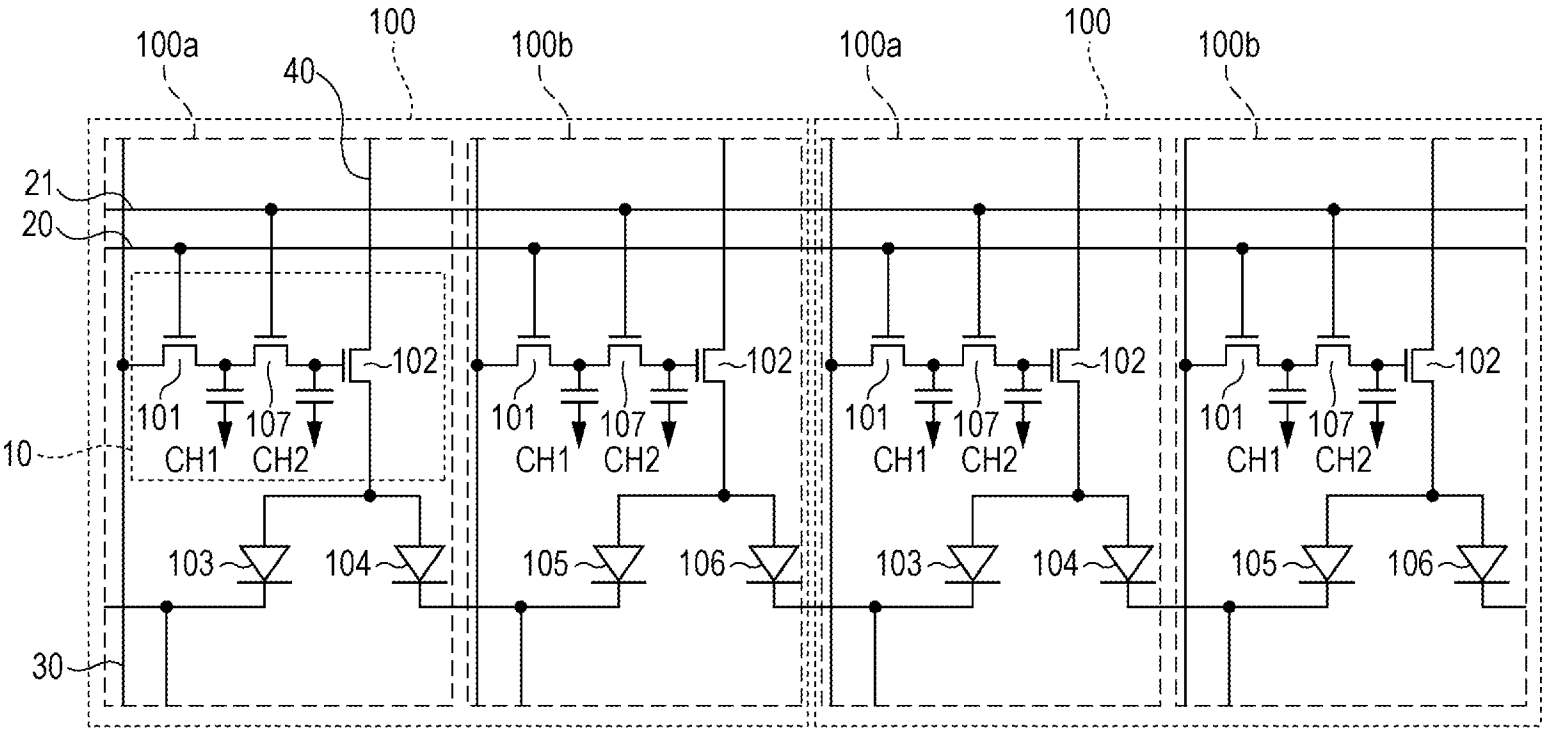
FIG. 11 is a diagram illustrating organic electroluminescent elements and a driving circuit thereof in a display apparatus according to an embodiment of the present invention.

FIG. 11 is a diagram illustrating a pixel configuration and a manner in which cathode wirings are connected according to a fourth embodiment of the present invention. Similar parts to those in FIG. 1 are denoted by similar reference numerals.

A pixel 100 includes four organic electroluminescent elements, i.e., an R (red) organic electroluminescent element 103, a first G (green) organic electroluminescent element 104, a B (blue) organic electroluminescent element 105, and a second G (green) organic electroluminescent element 106, which are arranged in this order in a row direction. These four organic electroluminescent elements 103 to 106 are arranged periodically in the row direction. In each column, organic electroluminescent elements of the same color are arranged although not shown in the figure.

Each pixel has two G (green) organic electroluminescent elements. In human eyes, among all colors, the greatest number of sense organs is provided for green color. By providing twice as many organic electroluminescent elements for green color as organic electroluminescent elements for red and blue, it is possible to increase the resolution compared with the structure in which organic electroluminescent elements of three colors are equally disposed. Hereinafter, the first green is denoted simply as G-I and the second green as G-II. A driving circuit 10 is configured in the same manner for all pixels, and each driving circuit 10 includes a selection transistor 101, a transfer transistor 107, a driving transistor 102, and two storage capacitors CH1 and CH2.

The driving transistor 102 in each driving circuit 10 is connected to a current supply line 40 that supplies a driving current to the organic electroluminescent element and also connected to anode electrodes of the organic electroluminescent elements 103 to 106 such that the current is supplied to these organic electroluminescent elements 103 to 106. The R organic electroluminescent element 103 and the G-I organic electroluminescent element 104 are driven in common by one driving circuit 10, while the B organic electroluminescent element 105 and the G-II organic electroluminescent element 106 are driven in common by another driving circuit 10. In the present embodiment, the R organic electroluminescent element and the G-I organic electroluminescent element form one sub-pixel 100*a*, while the B organic electroluminescent element and the G-II organic electroluminescent element form another sub-pixel 100*b*.

The cathodes of the organic electroluminescent elements 103 and 104 in the sub-pixel 100*a* are separately connected to the respective cathodes of the organic electroluminescent elements 105 and 106 in the adjacent sub-pixel 100*b*. More specifically, the cathode of the R organic electroluminescent element 103 in the sub-pixel 100*a* is connected to the cathode of the G-II organic electroluminescent element 106 in the adjacent sub-pixel 100*b*, and the cathode of the G-I organic electroluminescent element 104 in the sub-pixel 100*a* is connected to the cathode of the B organic electroluminescent element 105 in the adjacent sub-pixel 100*b*.

A display unit of a display apparatus is formed in the form of a pixel matrix including 1280 (=640×2) sub-pixels 100*a* and sub-pixels 100*b* arranged in the row direction and 480 sub-pixels 100*a* and sub-pixels arranged in the column direction.

Figure 12:
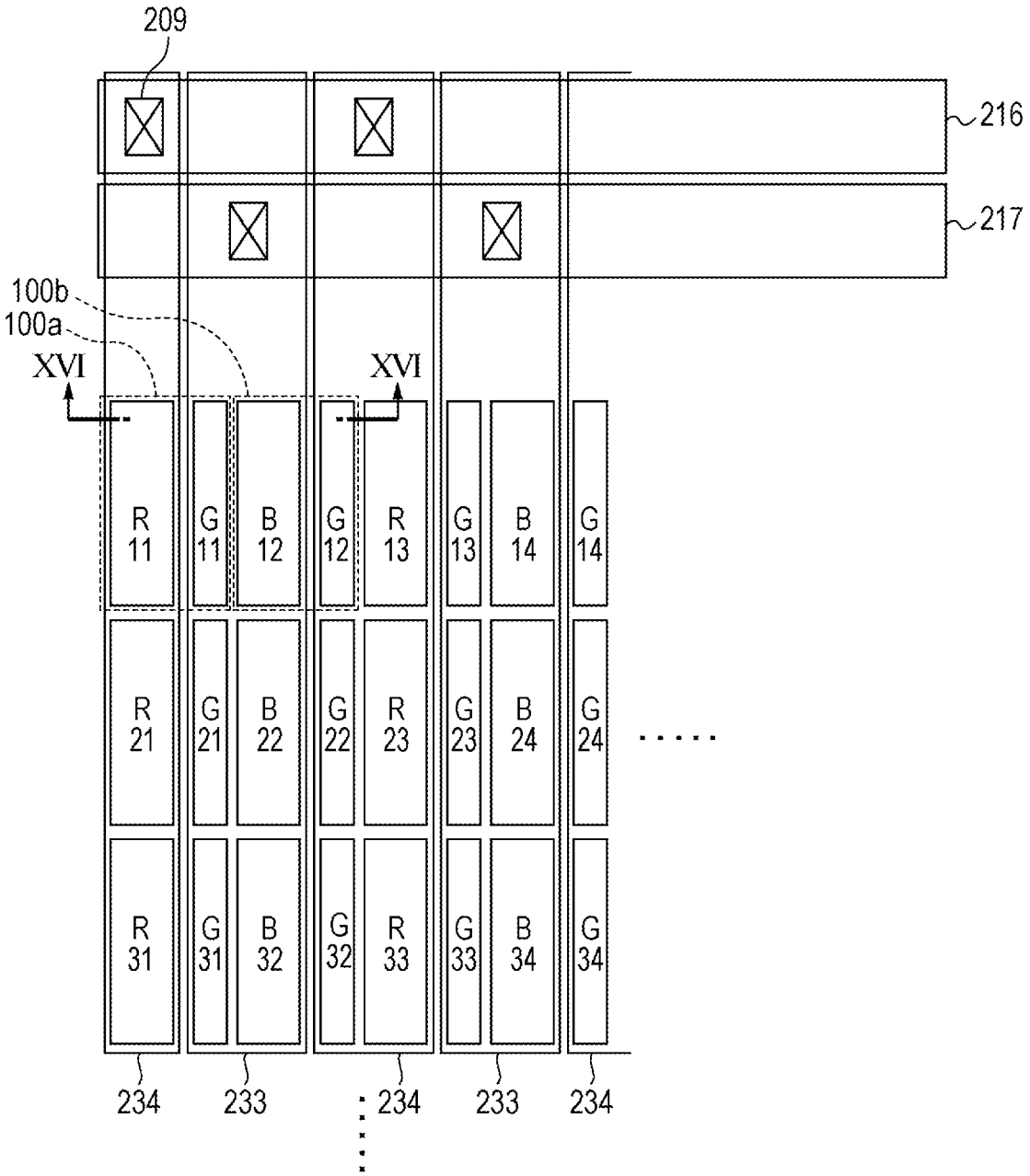
FIG. 12 is a diagram illustrating organic electroluminescent elements and cathode wirings in a display apparatus according to an embodiment of the present invention.

FIG. 12 illustrates a plane layout of organic electroluminescent elements and a manner in which cathode wirings are connected according to the present embodiment of the present invention.

In FIG. 12, rows and columns are numbered in units of sub-pixels, and an organic electroluminescent element of a sub-pixel in the I-th row and J-th column is denoted by RIJ. R organic electroluminescent elements 103 are located in odd-numbered columns and denoted by symbols R11, R13, . . . and so on, while G-I organic electroluminescent elements 104 are also located in odd-numbered columns are denoted by symbols G11, G13, . . . and so on.

B organic electroluminescent elements 105 are located in even-numbered columns and denoted by symbols B12, B14, . . . and so on, while G-II organic electroluminescent elements 106 are also located in even-numbered columns and denoted by symbols G12, G14, . . . and so on. The cathode of each organic electroluminescent element extends in the column direction such that it forms a single electrode together with cathodes of organic electroluminescent elements at upper and lower locations. This electrode is common for all cathodes of organic electroluminescent elements located in each column, and thus cathode wirings 233 and 234 are formed thereby.

In the present embodiment, not only in the column direction, but also in the row direction, cathodes of two adjacent organic electroluminescent elements in the same row are connected together into a single electrode, and thus the cathode wirings of organic electroluminescent elements in adjacent two columns are connected together into a single wiring. More specifically, a cathode wiring 234 is formed by the cathode shared by the G-I organic electroluminescent element G11 in the sub-pixel 100*a* and the B organic electroluminescent element B12 in the sub-pixel 100*b* to the right of the sub-pixel 100*a*. A cathode wiring 233 is formed by the cathode shared by the R organic electroluminescent element R13 in the sub-pixel 100*a* and the G-II organic electroluminescent element G12 in the sub-pixel 100*b* to the left of the sub-pixel 100*a*. In an outermost column, exceptionally, a cathode wiring is formed in a different manner such that a cathode wiring 233 is formed only by cathodes of organic electroluminescent elements R11, R21, R31, . . . and so on in one column.

The cathode wirings 233 and 234 extend into the outside of the display area and are connected alternately to the power supply lines 216 or 217 via contact holes 209. In the present embodiment, two power supply lines are provided and a light emission level voltage V1 and a no-light emission level voltage V2 are supplied to the two power supply lines from two cathode power supplies 212 and 213 such that the supplied voltages are switched periodically between V1 and V2.

Figure 13:
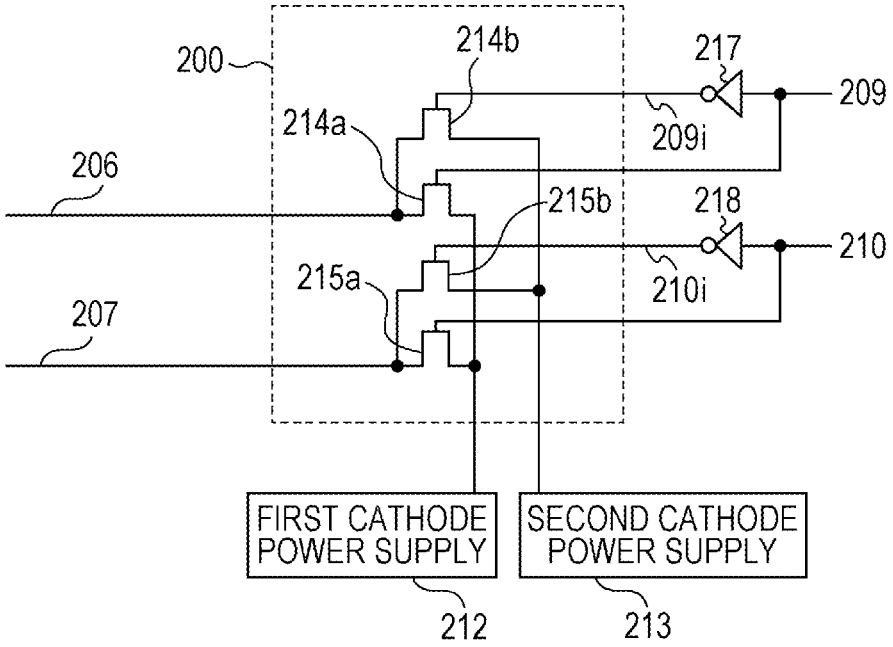
FIG. 13 is a diagram illustrating switch circuits of power supply lines in a display apparatus according to an embodiment of the present invention.

FIG. 13 illustrates a switch circuit 200 configured to switch the voltages of the power supply lines according to the present embodiment of the invention. This switch circuit 200 is similar to that shown in FIG. 3 except that the third power supply line 208 is removed. In FIG. 13, similar parts to those in FIG.

3 are denoted by similar reference numerals. The operation is similar to that of the switch circuit shown in FIG. 3. The power supply lines 206 and 207 are alternately connected to the power supply 212 that outputs the light emission level voltage V1 and the power supply 213 that outputs the no-light emission level voltage V2.

Figure 14:
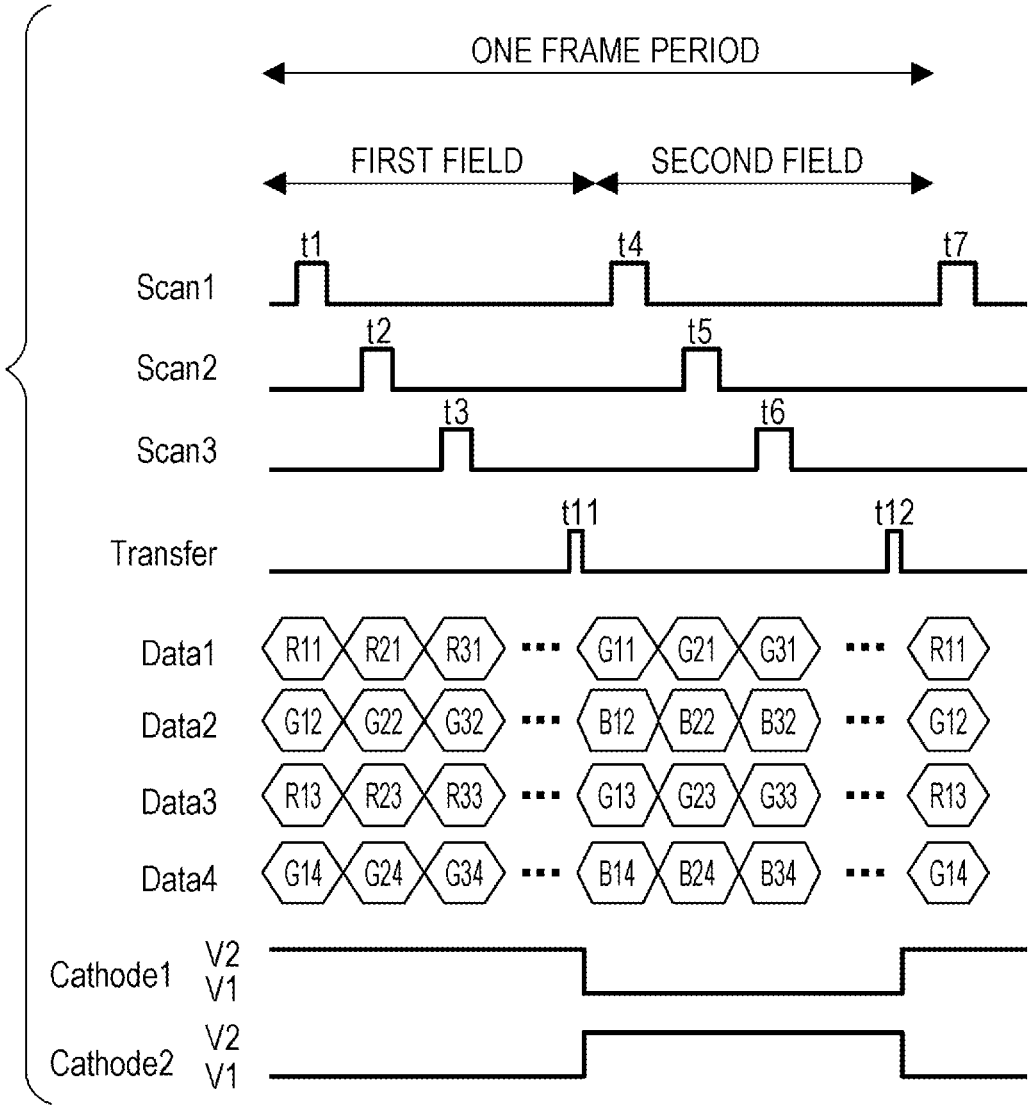
FIG. 14 is a timing chart illustrating an operation of a display apparatus according to an embodiment of the present invention.

FIG. 14 is a timing chart illustrating a driving method according to the present embodiment of the invention. Scan1, Scan2, and Scan3 denote voltage pulses applied to the selection line 20. Transfer denotes a voltage pulse applied to the transfer signal line 21. Data1 to Data4 denote data signals transmitted via data lines. Cathode1 denotes a voltage of the cathode wiring 213. Cathode2 denotes a voltage of the cathode wiring 214.

One frame is divided into a first half part (a first field) and a second half part (a second field). In the first field, the signals Scan1, Scan2, . . . and so on are applied to the selection lines 20 in the respective rows such that the selection potential (high level) is sequentially supplied to the gates of the selection transistors 101 on a row-by-row basis. The selection line Scan1 in the first row has the selection potential in a period t1 and data signals supplied via data lines (Data1 to Data4) are transferred to first-stage storage capacitors CH1 of the pixel circuits 10. The operation is repeated such that the second row is selected in a period t2, the third row is selected in a period t3, and so on whereby data signals are written in pixel circuits in all rows.

Subsequently, the signals Transfer of the transfer signal lines 21 are switched to the high level in a period t11 at the same time for all rows thereby to turn on the transfer transistors 107 in the pixel circuits 10. As a result, the voltage stored in each first-stage storage capacitor CH1 is transferred to a corresponding second-stage storage capacitor CH2. After the transfer signal lines return to the low level, the voltage stored in each second-stage storage capacitor CH2 is still applied to the gate of a corresponding driving transistor 102.

After the end of the period t11, the light emission level voltage V1 is applied to the first power supply line 206 (Cathode1) and the no-light emission level voltage V2 is applied to the second power supply line 207 (Cathode2). As a result, organic electroluminescent elements on cathode wirings 233 connected to the first power supply line 206 (Cathode1) are forward biased and thus currents flow therethrough and light is emitted. On the other hand, organic electroluminescent elements on cathode wirings 234 connected to the second power supply line 207 (Cathode2) are reverse biases and thus no current flows therethrough and light is not emitted. Thus, in the light emission period in the first field, only one of the two organic electroluminescent elements in each of the sub-pixels 100*a* and 100*b* is turned on to emit light, and the other one is turned off to emit no light. In the second field, the Scan1 has the selection potential in a period t4, and the Scan2 has the selection potential in a period t5. Subsequently, the following rows are sequentially switched to the selection potential and the writing operation is performed in a similar manner. Thereafter, the transfer signal line is switched to the selection potential (high level) in a period t12 and thus data signals are transferred to the gates of the driving transistors 102.

In the light emission period in the second field, the no-light emission level voltage V2 is applied to the first power supply line 206, while the light emission level voltage V1 is applied to the second power supply line 207. As a result, the organic electroluminescent element, which is located in each of the sub-pixels 100*a* and 100*b* and which were in the OFF state in the light emission period in the first field, is turned on to emit light, while the organic electroluminescent elements which were turned on to emit light in the first field are turned off and no light is emitted thereby.

Figure 15A:
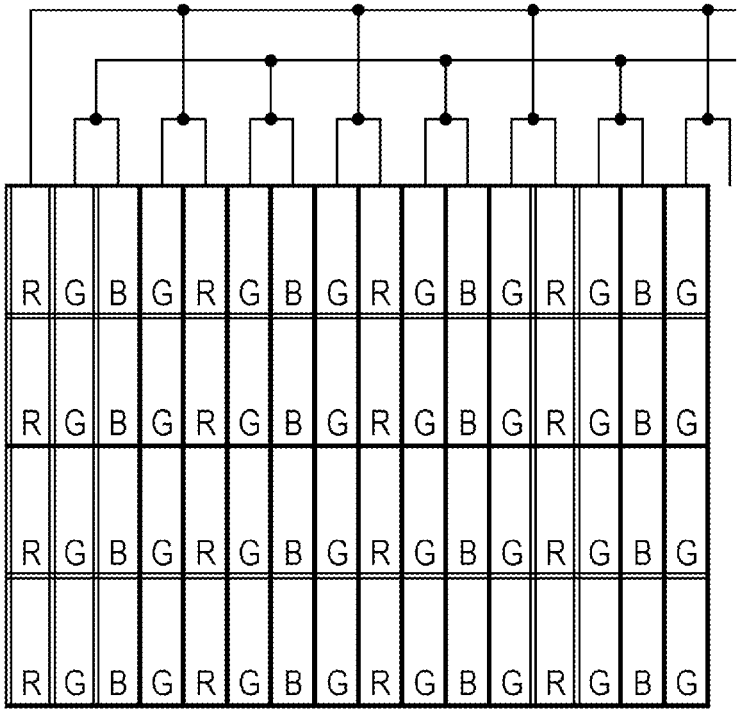
FIG. 15A is a diagram illustrating a layout of organic electroluminescent elements according to an embodiment of the present invention.
Figure 15B:
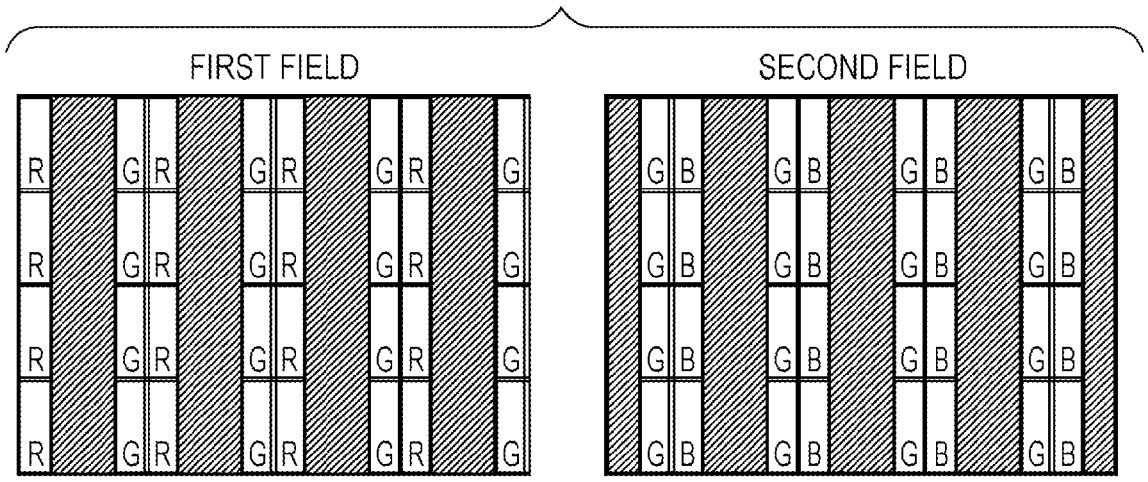
FIG. 15B is a diagram illustrating colors emitted by organic electroluminescent elements in each field.

FIG. 15A illustrates a manner in which cathode wirings are connected, and FIG. 15B illustrates which organic electroluminescent elements are turned on to light emit in each field. In FIG. 15A, cathode wirings are connected in a similar manner to those shown in FIG. 12.

As shown in FIG. 15B, in the first field, the R organic electroluminescent element of the pixel 100*a* and the G-II organic electroluminescent element of the pixel 100*b* are turned on to emit light. In the second field, the G-I organic electroluminescent element of the pixel 100*a* and the B organic electroluminescent element of the pixel 100*b* are turned on to emit light. Via the two fields, one frame of complete image is displayed, and the image can be seen by human eyes as a color image in which the two fields are averaged.

In the first to third embodiments described above, a mixture of RGB colors is emitted in each field. In contrast, in the present embodiment, an image displayed in each filed does not include all colors but the image includes part of colors. However, the image in each filed includes at least different two colors, and thus an occurrence of color break-up is suppressed. Next, a structure of an organic electroluminescent element and a method of producing the organic electroluminescent element according to the present embodiment are described below.

Figure 16:
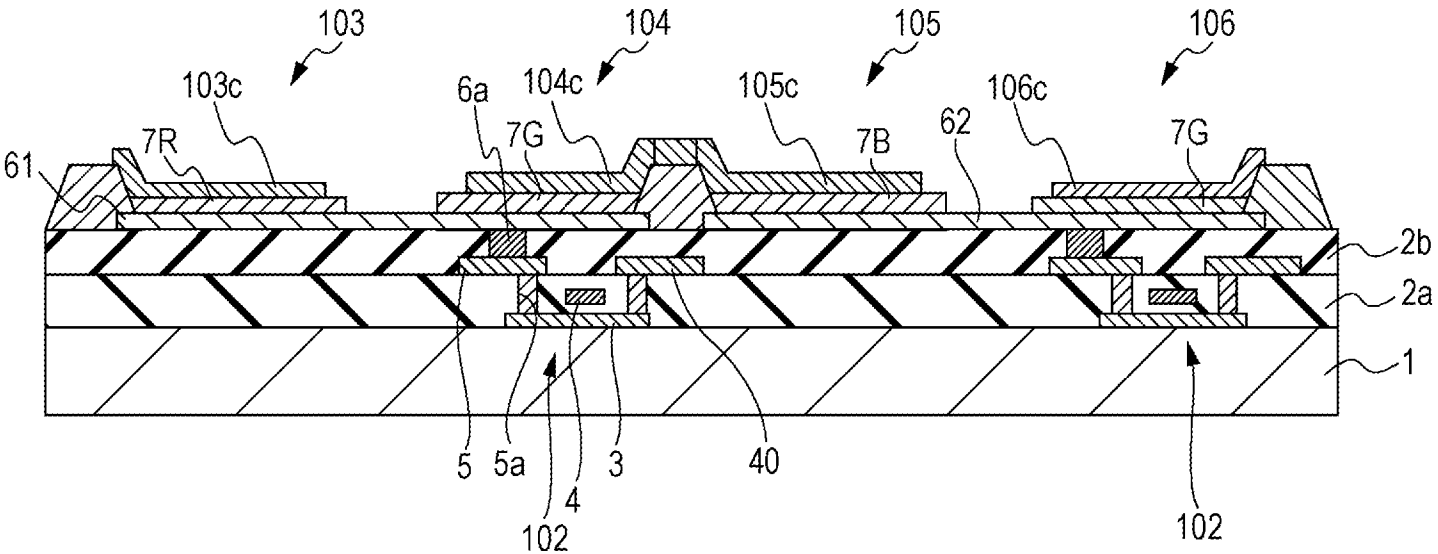
FIG. 16 is a diagram illustrating a cross-sectional structure of an organic electroluminescent element in a display apparatus according to an embodiment of the present invention.

FIG. 16 is a cross-sectional view of the organic electroluminescent element taken along a dotted line XVI-XVI of FIG. 12. Similar parts to those in FIG. 10 are denoted by similar reference numerals. Not those pixel circuit elements other than the driving transistor 102 are not shown in FIG. 16.

In a region on the left-hand side surrounded by a partition wall 9, an R organic electroluminescent element 103 and a G-I organic electroluminescent element 104 are formed. In a region on the right-hand side, another sub-pixel including two organic electroluminescent elements, i.e., a B organic electroluminescent element 105 and a G-II organic electroluminescent element 106 is formed. As described above, one sub-pixel is formed in one region surrounded by a partition wall 9.

Two organic electroluminescent elements in each region share an anode electrode 61 or 62 and these two organic electroluminescent elements are driven by a single driving transistor 102. R, G, and B organic layers 7R, 7G, and 7B including a light emitting material are formed such that each region includes organic layers of two colors, respectively. Cathodes of two organic electroluminescent elements in each region are formed separately, but cathodes 104C and 105C of the G-I and B organic electroluminescent elements are formed so as to extend over the partition wall 9. The cathodes are connected together via the partition wall 9. Although not shown in the figure, a cathode of the G-II organic electroluminescent element and a cathode of the R organic electroluminescent element are also connected together via a partition wall 9.

A method of forming two organic electroluminescent elements in a region surrounded by a partition wall is described below. A cathode electrode divided into two pieces may be formed as follows. First, a film of an electrode material such as Ag, ITO, IZO, or the like is formed across a whole area by using an evaporation process or a sputtering process, and then the film is divided by irradiation of laser light. Alternatively, patterning may be performed using a metal mask. Still alternatively, patterning may be performed using an inverse-tapered pixel isolation film, or other similar processes may be used.

Two separate organic layers of different colors may be formed by one of the following methods. A first method is to combine white organic electroluminescent elements with color filters. A second method is to form three types of organic electroluminescent layers of R, G, and B colors by using a laser transfer process. A third method is to perform evaporation using a metal mask.

Figure 17A:
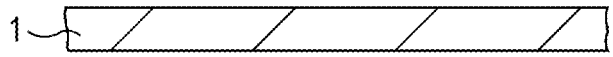
FIGS. 17A, 17B, 17C, 17D, and 17E are diagrams illustrating a process of producing an organic electroluminescent element according to an embodiment of the present invention.

Referring to FIGS. 17A to 17E, a sequence of processing steps of forming separate organic layers and cathodes is described in further detail below. FIG. 17A illustrates a substrate 1 made of silicon or glass. Although not shown in FIG. 17A, a circuit pattern and electrodes for driving organic electroluminescent elements have already been formed on the substrate 1.

Figure 17B:
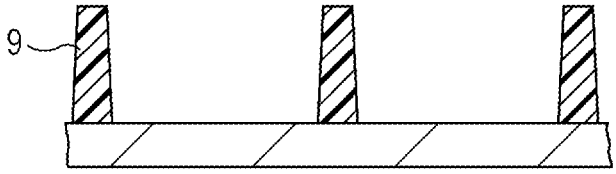

A photoresist material is coated on the substrate 1 and patterned to form partition walls 9 for partitioning pixels. FIG. 17B illustrates a resultant structure. The partition walls 9 are also called shadow walls, and a method of forming such a shadow wall may be found, for example, in Japanese Patent Laid-Open No. 2000-155538.

Figure 17C:
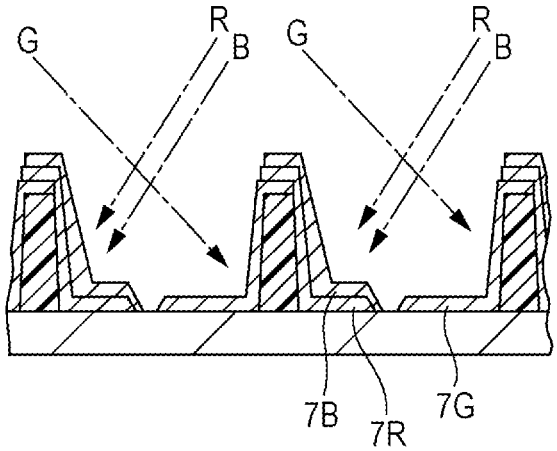

After the partition walls 9 are formed on the substrate 1, R, G, and B organic electroluminescent materials are obliquely evaporated as shown in FIG. 17C. In the example shown in FIG. 17C, a green organic layer 7G is formed by oblique evaporation from the left, and red and blue organic layers 7R and 7B are formed one on another by oblique evaporation from the right. Note that the organic layers 7R and 7B are formed in a multilayer structure. In regions shadowed by the partition walls 9, no evaporation material is deposited and thus two separate organic layers are formed in each region between the partition walls 9.

Figure 17D:
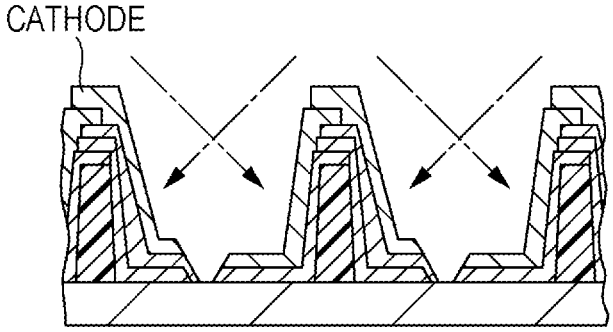

Next, a cathode electrode material is obliquely evaporation on the organic layer 7G and the multilayer of organic layers 7R/7B from the left and from the right. As a result, the cathode electrode material is deposited separately on the two organic layers between the partition walls 9. Thus, cathodes are formed as shown in FIG. 17D. In the oblique evaporation from the right and the left, the cathode electrode material is deposited on the upper surface of the partition walls 9, and thus the electrodes of the two organic electroluminescent elements adjacent to each other via the partition wall 9 are electrically connected to each other.

Figure 17E:
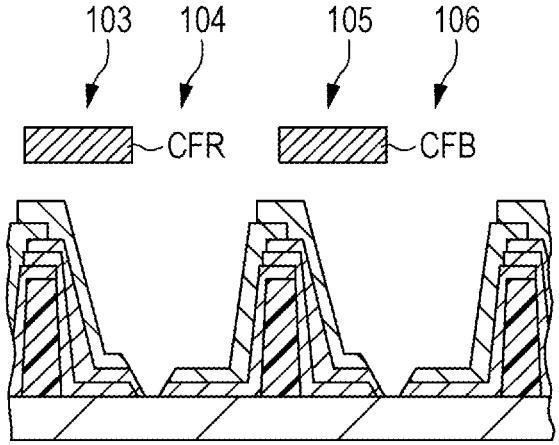

Finally, red color filters CFR and blue color filters CFB are placed alternately above the multilayer organic electroluminescent elements. Note that no color filter is formed on the green organic electroluminescent elements. As a result, color organic electroluminescent elements 103 to 106 are obtained as shown in FIG. 17E.

In this structure, R light and B light emit from the organic electroluminescent elements via the respective color filters. The color filters are formed by planarizing the upper part of each cathode by using an inorganic film such as a silicon nitride film and then directly forming the patterned color filters. Alternatively, patterned color filters may be formed on another glass substrate and this substrate may be bonded to the substrate on which organic electroluminescent elements are formed such that these two substrates are precisely positioned to each other.

The display apparatus produced via the process described above has low light absorption loss by the filters compared with the combination of white organic luminescent elements and color filters.

Fifth Embodiment

Figure 18:
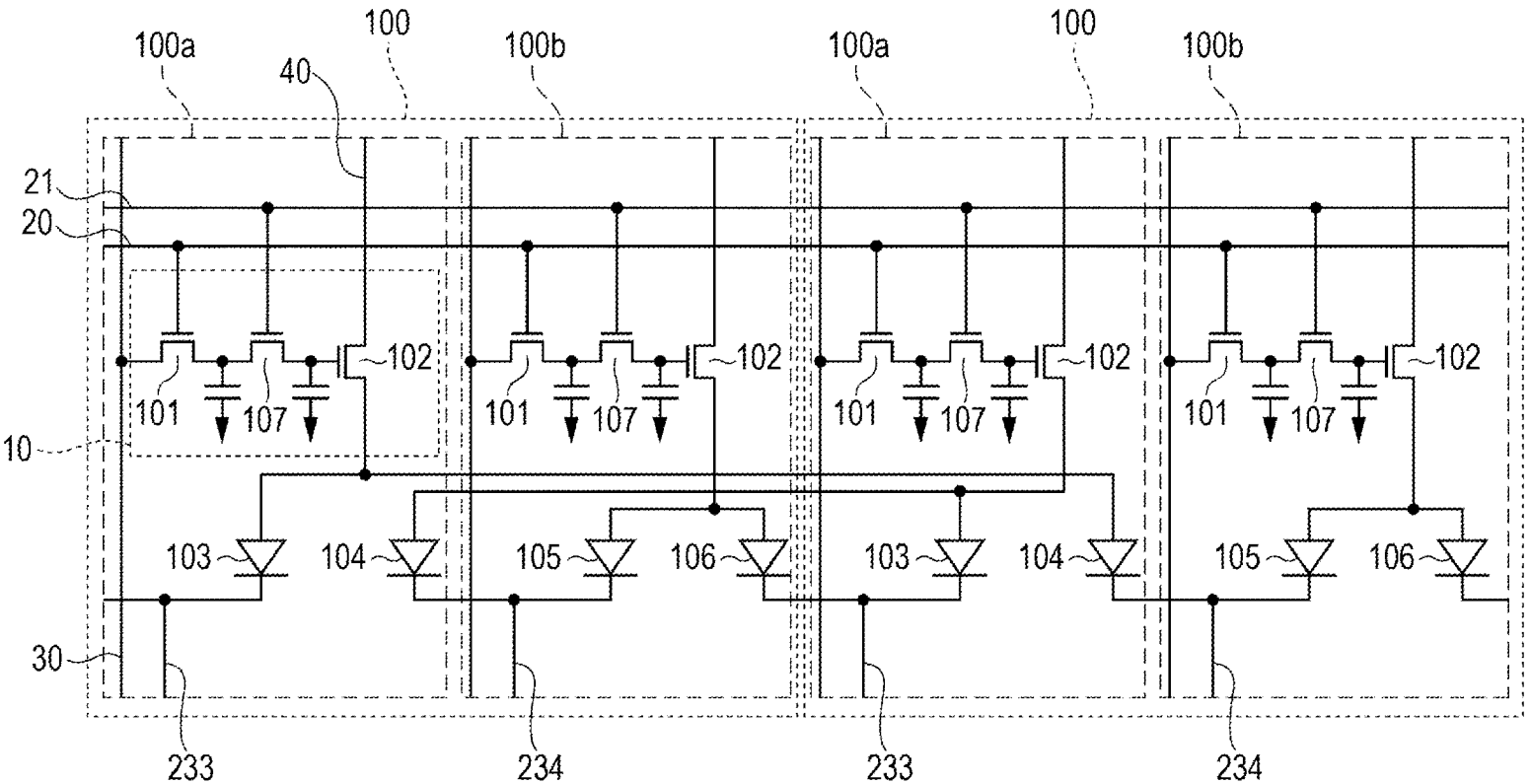
FIG. 18 is a diagram illustrating organic electroluminescent elements and a driving circuit thereof in a display apparatus according to an embodiment of the present invention.

FIG. 18 illustrates a circuit configuration according to a fifth embodiment of the present invention. A manner of arranging organic electroluminescent elements 103 to 106, a manner of supplying voltages to power supply lines, and a timing chart are similar to those according to the fourth embodiment. However, connections between the organic electroluminescent elements and driving circuits and connection between cathode wirings and the power supply lines are performed differently from the fourth embodiment.

As shown in FIG. 18, when columns are numbered starting with the leftmost column, in odd-numbered sub-pixels 100*a*, a driving circuit 10 is connected to an R organic electroluminescent element 103 in the same sub-pixel as that in which the driving circuit 10 is located and also to a G-I organic electroluminescent element 104 in another sub-pixel (sub-pixel 100*a* adjacent via one sub-pixel).

In even-numbered sub-pixel 100*b*, a driving circuit 10 is connected to a B organic electroluminescent element 105 and a G-II organic electroluminescent element 106*i* n the same sub-pixel as that in which the driving circuit 10 is located.

Figure 19:
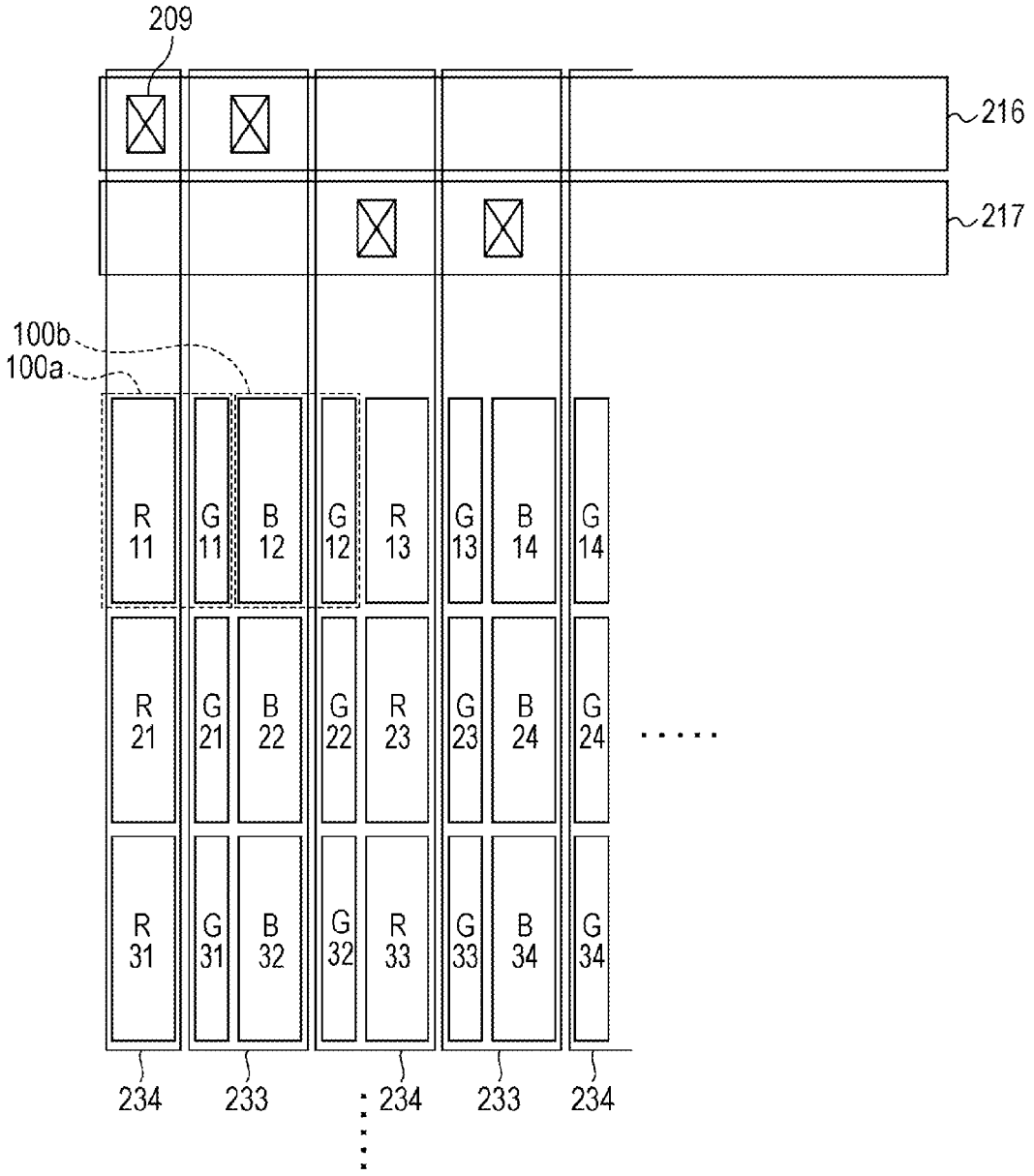
FIG. 19 is a diagram illustrating organic electroluminescent elements and cathode wirings in a display apparatus according to an embodiment of the present invention.

FIG. 19 illustrates a manner in which cathode wirings are connected to power supply lines according to the present embodiment of the invention. Note that connections are the same as those shown in FIG. 20A that will be referred to in a later explanation.

In the present embodiment, unlike the fourth embodiment described above with reference to FIG. 12 and FIG. 15A, two cathode wirings 233 and 234 are connected to one power supply line. In this connection scheme, except for outermost columns, a total of four organic electroluminescent elements adjacent in the row direction, i.e., two organic electroluminescent elements in each odd-numbered column, one organic electroluminescent element in an even-numbered column located left to this odd-numbered column, and one organic electroluminescent element in an even-numbered column located right to this odd-numbered column are connected to the same power supply line. Four organic electroluminescent elements adjacent to the above-described four organic electroluminescent elements are connected to the other power supply line.

To the four organic electroluminescent elements adjacent in the row direction, the light emission level voltage and the no-light emission level voltage are alternately supplied to the cathodes thereof to turn them on and off at the same time. Therefore, these four organic electroluminescent elements are individually driven by different driving circuits. FIG. 19 illustrates a manner in which driving circuits are connected to organic electroluminescent elements so as to satisfy the above requirement. More specifically, the organic electroluminescent element 106 in the second column is driven by the driving circuit in the second column. The R organic electroluminescent element 103 in the third column is driven by the driving circuit in the third column. The G-I organic electroluminescent element 104 in the third column is driven by the driving circuit in the first column. The B organic electroluminescent element 105 in the fourth column is driven by the driving circuit in the fourth column. These four driving circuits in the first to fourth columns are also connected to other four organic electroluminescent elements that are to be turned on in the other field.

Figure 20A:
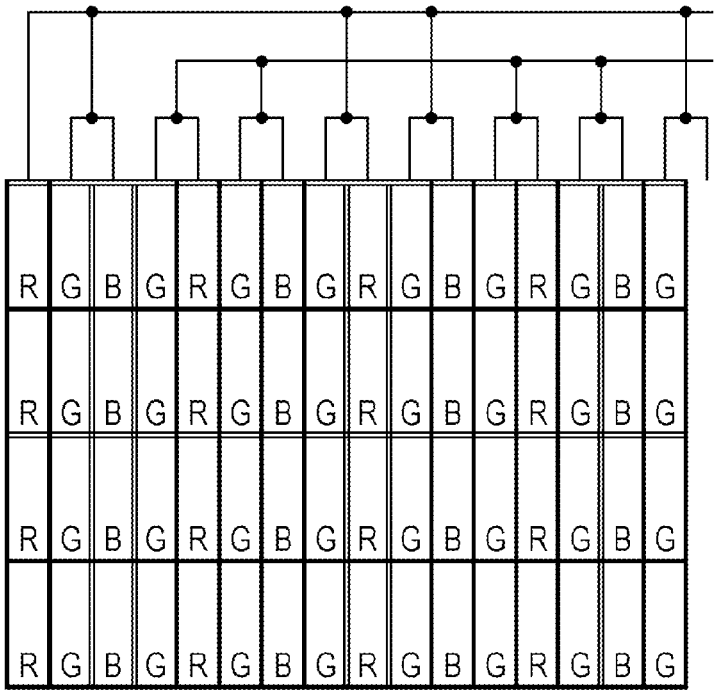
FIG. 20A is a diagram illustrating a layout of organic electroluminescent elements according to an embodiment of the present invention.
Figure 20B:
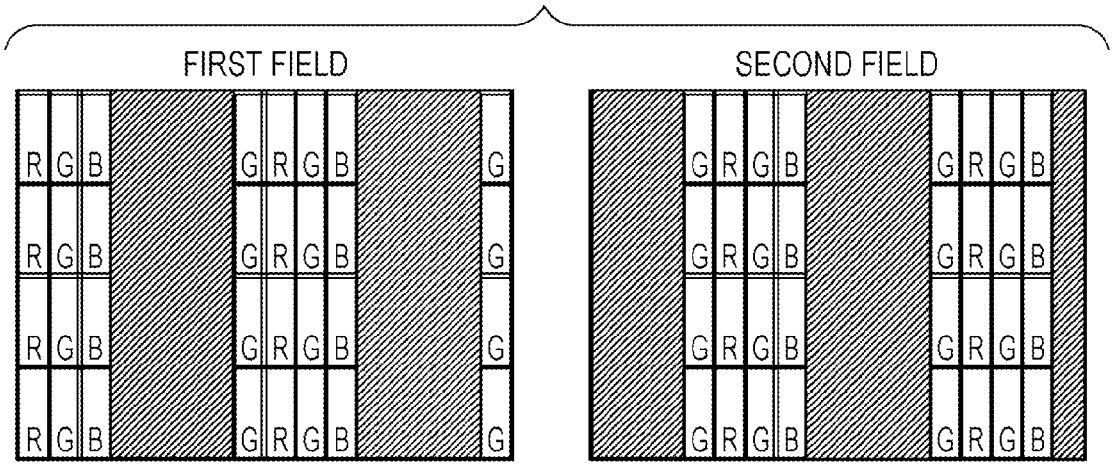
FIG. 20B is a diagram illustrating colors emitted by organic electroluminescent elements in each field.

FIG. 20A illustrates a manner in which cathode wirings are connected to power supply lines according to the present embodiment of the invention. FIG. 20B illustrates which organic electroluminescent elements are turned on to light emit in each field. In FIG. 20A, cathode wirings are connected in a similar manner to those shown in FIG. 19.

In the configuration associated with the connection of cathode wirings according to the present embodiment, in the first field, turning-on to emit light is performed at the same time for R organic electroluminescent elements R11, R21, R31, . . . and so on in the first column, G-I organic electroluminescent elements G11, G21, G31, . . . and so on in the first column, B organic electroluminescent elements B12, B22, B32, . . . and so on in the second column, G-II organic electroluminescent elements G14, G24, G34, . . . and so on in the fourth column, R organic electroluminescent elements R15, R25, R35, . . . and so on in the fifth column, G-I organic electroluminescent elements G15, G25, G35, . . . and so on in the fifth column, and B organic electroluminescent elements B16, B26, B36, . . . and so on in the sixth column.

In the second field, turning-on to emit light is performed at the same time for G-II organic electroluminescent elements G12, G22, G32, . . . and so on in the second column, R organic electroluminescent elements R13, R23, R33, . . . and so on in the third column, G-I organic electroluminescent elements G13, G23, G33, . . . and so on in the third column, B organic electroluminescent elements B14, B24, B34, . . . and so on in the fourth column, B-II organic electroluminescent elements G16, G26, G36, . . . and so on in the sixth column, R organic electroluminescent elements R17, R27, R37, . . . and so on the seventh column, G-I organic electroluminescent elements G17, G27, G37, . . . and so on in the seventh column, and B organic electroluminescent elements B18, B28, B38, . . . and so on in the eight column.

That is, four organic electroluminescent elements 103 to 106 forming a pixel are turned on at the same time to emit light in one field. Organic electroluminescent elements are turned on in a similar manner also in the other field. In each field, a mixture of red, green, and blue colors is emitted, and thus color break-up does not occur in usual moving images such as natural images.

In the present embodiment, driving circuits 10 in each odd-numbered column drive organic electroluminescent elements in different two pixels. As described above, a set of organic electroluminescent elements that receive a current supplied from one driving circuit is not necessarily included in one pixel.

In the first to third embodiments described above, three organic electroluminescent elements of R, G, and B colors in each pixel are connected to different power supply lines, and thus it is possible to drive these three organic electroluminescent elements by one driving circuit. That is, a set of organic electroluminescent elements that are driven by the same driving circuit is a set of organic electroluminescent elements that form one pixel.

In the fourth embodiment, not all but part of organic electroluminescent elements in each pixel (for example, GI and B of R, G-I, B, and G-II) share one cathode, and thus at least two these organic electroluminescent elements are driven by different driving circuits. Therefore, two driving circuits are provided in each pixel.

In the fifth embodiment, four adjacent organic electroluminescent elements located over two pixels, i.e., R, G-I, and B organic electroluminescent elements located in one pixel and a G-II organic electroluminescent element located in an adjacent pixel are activated at the same time to emit light such that an image displayed in one field includes all colors. To drive four organic electroluminescent elements by different driving circuits, a driving circuit located in one pixel drives an organic electroluminescent element located in that pixel and also an organic electroluminescent element located in a pixel adjacent thereto via one another pixel.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-131248 filed Jun. 8, 2010 and No. 2011-089375, filed Apr. 13, 2011, which are hereby incorporated by reference herein in their entirety.

What is claimed is:

1. An apparatus comprising:

a plurality of light emitting elements configured to emit light of colors assigned to respective light emitting elements by providing currents flowing between first and second electrodes, a set of the light emitting elements which emit light of mutually different colors constituting a pixel;

a plurality of driving circuits each connected to the first electrodes of the light emitting elements of the pixel in common;

a plurality of wiring formed by the second electrodes of the light emitting elements of the pixel extending and being connected to the second electrodes of the light emitting elements of another pixel; and a plurality of power supply lines being connected to the wirings and configured to sequentially apply voltages to the second electrodes of the light emitting elements thorough the wirings to cause the light emitting elements to emit light, wherein at least a part of the second electrodes of the light emitting elements of the pixel are separately formed and the separately formed second electrodes are connected to the different power supply lines through the wirings, and wherein the light emitting elements whose second electrodes are connected to one of the power supply lines through the wirings include light emitting elements configured to emit light of different colors.

2. The apparatus according to claim 1, wherein the light emitting elements whose second electrodes are connected to one of the power supply lines include light emitting elements configured to emit light of all colors composing pixel.

3. The apparatus according to claim 1, wherein the second electrodes configured to emit light of different colors are connected together by one of the wirings.

4. The apparatus according to claim 1, wherein the set of the light emitting elements are isolated by a partition wall from an adjacent set of the light emitting elements, the second electrodes are formed to extend over the partition wall and connected to the second electrodes of the adjacent set of the light emitting elements.

5. The apparatus according to claim 1, wherein the driving circuit includes a driving transistor, a selection transistor, and a storage capacitor, the driving transistor being connected such that a drain is connected to the first electrode and a gate is connected to an end of the storage capacitor, and the selection transistor being connected such that a drain is connected to a data line and a source is connected to the gate of the driving transistor.

6. The apparatus according to claim 1, wherein the power supply lines are connected to a switch circuit configured to switch a voltage of the power supply lines between a voltage that turns on light emitting elements to emit light and a voltage that turns off light emitting elements to emit no light.

7. A method of driving the apparatus according to claim 1, the method comprising:

applying a voltage, that causes the light emitting elements to emit light, to one of the power supply lines and applying a voltage, that causes light emitting elements to emit no light, to the other power supply lines, wherein the applying the voltage is performed sequentially for the plurality of power supply lines.

8. The method according to claim 7, wherein the light emitting elements, of the apparatus, whose second electrodes are connected to one of the power supply lines include light emitting elements configured to emit light of all colors composing the set of the light emitting elements.

9. The method according to claim 7, wherein the second electrodes configured to emit light of different colors are connected together by one of the wirings.

10. The method according to claim 7, wherein the set of the light emitting elements, of the apparatus, are isolated by a partition wall from an adjacent set of the light emitting elements, the second electrodes are formed to extend over the partition wall and connected to the second electrodes of the adjacent set of the light emitting elements.

11. The method according to claim 7, wherein the driving circuit, of the apparatus, includes a driving transistor, a selection transistor, and a storage capacitor, the driving transistor being connected such that a drain is connected to the first electrode and a gate is connected to an end of the storage capacitor, and the selection transistor being connected such that a drain is connected to a data line and a source is connected to the gate of the driving transistor.

12. The method according to claim 7, wherein the power supply lines, of the apparatus, are connected to a switch circuit configured to switch a voltage of the power supply lines between a voltage that turns on light emitting elements to emit light and a voltage that turns off light emitting elements to emit no light.

13. The method according to claim 7, wherein the signals are written to each of the driving circuits before applying the voltage to one of the power supply lines.

* * * * *